US011239589B2

(12) United States Patent
Takai et al.

(10) Patent No.: US 11,239,589 B2
(45) Date of Patent: Feb. 1, 2022

(54) HOST CONNECTOR AND RECEPTACLE ASSEMBLY INCLUDING SAME

(71) Applicant: YAMAICHI ELECTRONICS CO., LTD., Tokyo (JP)

(72) Inventors: Yosuke Takai, Tokyo (JP); Toshiyasu Ito, Tokyo (JP)

(73) Assignee: YAMAICHI ELECTRONICS CO., LTD., Tokyo (JP)

( * ) Notice: Subject to any disclaimer, the term of this patent is extended or adjusted under 35 U.S.C. 154(b) by 0 days.

(21) Appl. No.: 16/871,684

(22) Filed: May 11, 2020

(65) Prior Publication Data

US 2020/0358217 A1 Nov. 12, 2020

(30) Foreign Application Priority Data

May 10, 2019 (JP) ..... JP2019-089803

(51) Int. Cl.
*H01R 12/72* (2011.01)
*H01R 13/6471* (2011.01)

(52) U.S. Cl.
CPC ..... *H01R 12/724* (2013.01); *H01R 12/725* (2013.01); *H01R 13/6471* (2013.01)

(58) Field of Classification Search
CPC ..... H01R 13/6461; H01R 13/6471; H01R 13/6582; H01R 13/65914; H01R 13/6594;
(Continued)

(56) References Cited

U.S. PATENT DOCUMENTS 3,199,066 A * 8/1965 Eledge ..... H01R 12/716 439/857
6,007,389 A * 12/1999 Weber ..... H01R 43/20 439/636

(Continued)

FOREIGN PATENT DOCUMENTS

CN 1396678 A 2/2003
CN 204964818 U 1/2016

(Continued)

OTHER PUBLICATIONS

An Office Action mailed by China National Intellectual Property Administration dated May 8, 2021, which corresponds to Chinese Patent Application No. 202010197959.4 and is related to U.S. Appl. No. 16/871,684; with Englist language translation.

*Primary Examiner* — Marcus E Harcum
(74) *Attorney, Agent, or Firm* — Studebaker & Brackett PC

(57) ABSTRACT

A host connector includes a connector insulator having a slot allowing detachable insertion of a plug connector of a module, a first contact terminal group including contact terminals arranged inside the connector insulator and each brought into contact with a contact pad on one side at a connection end of the plug connector, and a second contact terminal group including contact terminals each brought into contact with a contact pad on another side opposed to the aforementioned contact pad. The first contact terminal group includes grounding sub-contact terminals arranged inside slits of the connector insulator, grounding main contact terminals supporting the grounding sub-contact terminals, and signal contact terminals. Contact portions of each grounding main contact terminal and of each signal contact terminal having the same shape are arranged on a common
(Continued)

straight line, and the signal contact terminals are disposed between the grounding main contact terminals.

9 Claims, 21 Drawing Sheets

(58) Field of Classification Search
CPC ..... H01R 13/6597; H01R 12/724; H01R 12/725; H01R 12/737
USPC ..... 439/101, 104, 108, 636, 857, 862
See application file for complete search history.

(56) References Cited

U.S. PATENT DOCUMENTS 6,261,107 B1* 7/2001 Takase ..... H01R 12/57 439/636
6,347,962 B1 2/2002 Kline
6,447,317 B1* 9/2002 Billman ..... H01R 13/6582 439/260
7,922,495 B2* 4/2011 Masuda ..... H01R 12/87 439/59
9,711,883 B2* 7/2017 Ito ..... H01R 12/712
9,930,781 B2 3/2018 Takai et al.
10,553,971 B1* 2/2020 Phillips ..... H01R 12/716
10,574,002 B1* 2/2020 Henry ..... H01R 13/6587
2009/0221165 A1* 9/2009 Buck ..... H01R 13/514 439/108
2011/0269346 A1* 11/2011 Casher ..... H01R 29/00 439/626
2012/0064743 A1* 3/2012 Qin ..... H01R 13/6471 439/92
2013/0288513 A1* 10/2013 Masubuchi ..... H01R 12/775 439/386
2015/0255904 A1* 9/2015 Ito ..... H01R 13/6471 439/88
2016/0006182 A1* 1/2016 Patel ..... H01R 13/6597 439/108
2017/0018880 A1* 1/2017 Phillips ..... H01R 12/727
2017/0018883 A1* 1/2017 Chen ..... H01R 13/6585
2017/0170606 A1* 6/2017 Phillips ..... H01R 12/7005
2018/0090887 A1* 3/2018 Little ..... H01R 13/6594
2018/0166812 A1* 6/2018 Lin ..... H01R 12/721
2018/0294592 A1* 10/2018 Huang ..... H01R 12/721
2018/0366884 A1* 12/2018 Tseng ..... H01R 13/6585
2019/0097357 A1* 3/2019 Mongold ..... H03H 7/38
2019/0131743 A1* 5/2019 Hsu ..... H01R 13/405
2019/0214755 A1* 7/2019 Manickam ..... H01R 12/721
2020/0006899 A1* 1/2020 Muro ..... H01R 12/79
2020/0099149 A1* 3/2020 Xu ..... H01R 12/716
2020/0176905 A1* 6/2020 Buck ..... H01R 13/6471
2020/0212632 A1* 7/2020 Liong ..... H01R 12/716
2020/0313358 A1* 10/2020 Casher ..... H01R 12/57

FOREIGN PATENT DOCUMENTS

CN 109962353 A 7/2019
CN 211295437 U 8/2020

* cited by examiner

HOST CONNECTOR AND RECEPTACLE ASSEMBLY INCLUDING SAME

CROSS-REFERENCES TO RELATED APPLICATIONS

This application claims the benefit of Japanese Patent Application No. 2019-089803, filed May 10, 2019, which is hereby incorporated by reference herein in its entirety.

BACKGROUND OF THE INVENTION

Field of the Invention

The present invention relates to a host connector and a receptacle assembly including the same.

Description of the Related Art

A transceiver module assembly has been in practical use in an optical communication system in order for an optical signal transmitted by using an optical connector and the like to be transferred to a mother board. As disclosed in U.S. Pat. No. 9,930,781, for example, such a transceiver module assembly comprises a module and a receptacle assembly to which the module is detachably mounted.

The receptacle assembly comprises a bracket that guides a module at the time of attachment and detachment of the module, a pair of guide rail members that constitutes a module accommodating portion to attachably and detachably accommodate the module through the bracket, a heat-sink unit that dissipates heat generated from the module, a host connector that electrically connects contact pads of a plug connector of the mounted module to conductive patterns on a printed wiring board, and a connector cover that covers the host connector, as main elements (see FIG. 4 in U.S. Pat. No. 9,930,781).

As shown in FIGS. 14A and 14B, a host connector 4 mentioned above comprises: a connector insulator 4B provided with a slot 4A into which the plug connector of the module is detachably inserted; a first contact terminal group brought into contact with contact pads on one side at a connection end of the plug connector; and a second contact terminal group brought into contact with contact pads on another side opposed to the contact pads on the one side at the connection end of the plug connector. Each of the first contact terminal group and the second contact terminal group is configured to electrically connect the plug connector of the module to groups of electrodes coupled to the conductive patterns on the printed wiring board on which the receptacle assembly is disposed. For example, a connection end accommodating portion provided with a plurality of slits formed at given intervals along a longitudinal direction is provided to a peripheral edge of the slot 4A of the connector insulator 4B that is made of a resin material, for example.

The first contact terminal group comprises a plurality of grounding contact terminals 2Gi and a plurality of signal contact terminals 2Ai which are disposed in the respective slits formed at an upper part of the connector insulator 4B. In order to reduce crosstalk between adjacent channels, the grounding contact terminals 2Gi are disposed on both besides of a pair of the signal contact terminals 2Ai, respectively. A space between each grounding contact terminal 2Gi and its adjacent signal contact terminal 2Ai as well as a space between the adjacent signal contact terminals 2Ai is partitioned by a partition wall 4UPi. Hereby, the first contact terminal group includes the terminals repeatedly arranged from one end to another end of the connector insulator 4B in order of the grounding contact terminal 2Gi (G), the signal contact terminal 2Ai (S), the signal contact terminal 2Ai (S), the grounding contact terminal 2Gi (G), G, S, S, G, and so on.

Each signal contact terminal 2Ai comprises a movable piece portion 2AM provided with a contact portion 2*ac* brought into contact with the corresponding contact pad, and a fixed terminal portion 2AF that is continuous with an end of the movable piece portion 2AM and bent in such a way as to be perpendicular to a surface of the printed wiring board. Each grounding contact terminal 2Gi comprises a movable piece portion 2GM provided with a contact portion 2*gc* brought into contact with the corresponding contact pad, and a fixed terminal portion 2GF that is continuous with an end of the movable piece portion 2GM and bent in such a way as to be perpendicular to the surface of the printed wiring board. One end of the fixed terminal portion 2GF is fixed by soldering to the corresponding conductive pattern on the printed wiring board located at a back surface portion of the connector insulator 4B. A length of the fixed terminal portion 2GF is set substantially equal to a length of the fixed terminal portion 2AF of the signal contact terminal 2Ai. A length of the movable piece portion 2GM extending into the slit is set larger than a length of the corresponding movable piece portion 2AM of the signal contact terminal 2Ai. Accordingly, the position of the contact portion 2*gc* of the movable piece portion 2GM becomes a position located closer to the slot 4A than the position of the contact portion 2*ac* of the corresponding movable piece portion 2AM of the signal contact terminal 2Ai is.

The second contact terminal group comprises a plurality of grounding contact terminals 2Bi and a plurality of signal contact terminals 2Di which are arranged in the respective slits formed at a lower part of the connector insulator 4B and communicates with the above-described connection end accommodating portion. Because the grounding contact terminals 2Bi and the signal contact terminals 2Di have the same shape, a structure of the grounding contact terminal 2Bi will be described below while omitting an explanation of the signal contact terminal 2Di.

Each grounding contact terminal 2Bi comprises a movable piece portion 2BM provided with a contact portion 2*bc* brought into contact with a corresponding contact pad on the other side at the connection end of the plug connector, and a fixed terminal portion 2BF that is continuous with an end of the movable piece portion 2BM and bent toward the slot 4A in such a way as to be substantially parallel to the surface of the printed wiring board. In each of the slits, the contact portion 2*bc* of the grounding contact terminal 2Bi and the above-described contact portion 2*gc* of the grounding contact terminal 2Gi are arranged in such a way as to face each other. One end of the fixed terminal portion 2BF is fixed by soldering to the corresponding conductive pattern on the printed wiring board located immediately below the slot 4A of the connector insulator 4B.

According to the above-described configuration, in a case where the connection end of the plug connector of the module is connected to the first contact terminal group and to the second contact terminal group of the host connector 4, the contact portions 2*gc* of the grounding contact terminals 2Gi and the contact portions 2*bc* of the grounding contact terminals 2Bi are first brought into contact with the corresponding contact pads at the connection end of the plug connector, respectively. Then, the contact portions 2*ac* of the signal contact terminals 2Ai and contact portions 2*dc* of the signal contact terminal 2Di are brought into contact with the corresponding contact pads at the connection end of the plug connector, respectively.

SUMMARY OF THE INVENTION

In recent years, there has also been a demand for good transmission characteristics in a case where a frequency band used for data transmission by the transceiver module assembly is a relatively high-frequency band in excess of 100 GHz so as to transmit a large volume of data at a high speed.

Nevertheless, if data is transmitted in a relatively high-frequency band of 100 GHz or above, for example, by using the receptacle assembly that is provided with the above-described host connector disclosed in U.S. Pat. No. 9,930,781, there is a possibility that crosstalk in the host connector may be increased in the case where the grounding contact terminals 2Gi and the signal contact terminals 2Ai adjacent thereto have different shapes, thus leading to deterioration of frequency characteristics.

In view of the above-described problem, the present invention aims to provide a host connector including a plurality of contact terminals and to provide a receptacle assembly including the host connector. The host connector including a plurality of contact terminals and the receptacle assembly including the host connector are free from a possibility of deterioration of transmission characteristics even in a case where a frequency band for transmitting data is a relatively high-frequency band.

To achieve the above-described object, a host connector according to an aspect of the present invention comprises: a connector insulator including a slot into which a connection end of a module is detachably inserted; and a contact terminal group formed from a plurality of contact terminals placed inside the connector insulator and each brought into contact with a contact pad on the connection end, wherein the contact terminal group comprises a plurality of grounding sub-contact terminals, grounding main contact terminals for supporting ends of the grounding sub-contact terminals, respectively, and a plurality of signal contact terminals having a shape identical to a shape of the grounding main contact terminals and a contact portion of each grounding main contact terminal and a contact portion of each signal contact terminal are arranged on a common straight line extending along a direction of arrangement of the contact terminals, and the plurality of signal contact terminals are disposed between the grounding main contact terminals.

Moreover, a host connector according to another aspect of the present invention comprises: a connector insulator including a slot into which a connection end of a module is detachably inserted; a first contact terminal group formed from a plurality of contact terminals arranged inside the connector insulator and each brought into contact with a contact pad on one side of the connection end; and a second contact terminal group formed from a plurality of contact terminals each brought into contact with a contact pad on another side opposed to the contact pad on one side of the connection end, wherein the first contact terminal group comprises a plurality of grounding sub-contact terminals, grounding main contact terminals for supporting ends of the grounding sub-contact terminals, respectively, and a plurality of signal contact terminals having a shape identical to a shape of the grounding main contact terminals, and a contact portion of each grounding main contact terminal and a contact portion of each signal contact terminal are arranged on a common straight line extending along a direction of arrangement of the contact terminals, and the plurality of signal contact terminals are disposed between the grounding main contact terminals.

In addition, a receptacle assembly according to an aspect of the present invention comprises: a guide member placed on a wiring board and for forming a module accommodating portion that detachably accommodates a module including a module board and guiding the module; the above-described host connector placed on the wiring board and located adjacent to the module accommodating portion; and a connector cover for covering the host connector.

According to the host connector and the receptacle assembly including the same of the present invention, the contact portion of each grounding main contact terminal and the contact portion of each signal contact terminal are arranged on the common straight line extending along the direction of arrangement of the contact terminals, and the plurality of signal contact terminals are disposed between the grounding main contact terminals. As a consequence, the host connector and the receptacle assembly are free from a possibility of deterioration of transmission characteristics even in a case where a frequency band for transmitting data is a relatively high-frequency band.

Further features of the present invention will become apparent from the following description of exemplary embodiments with reference to the attached drawings.

DESCRIPTION OF THE EMBODIMENTS

Figure 5:
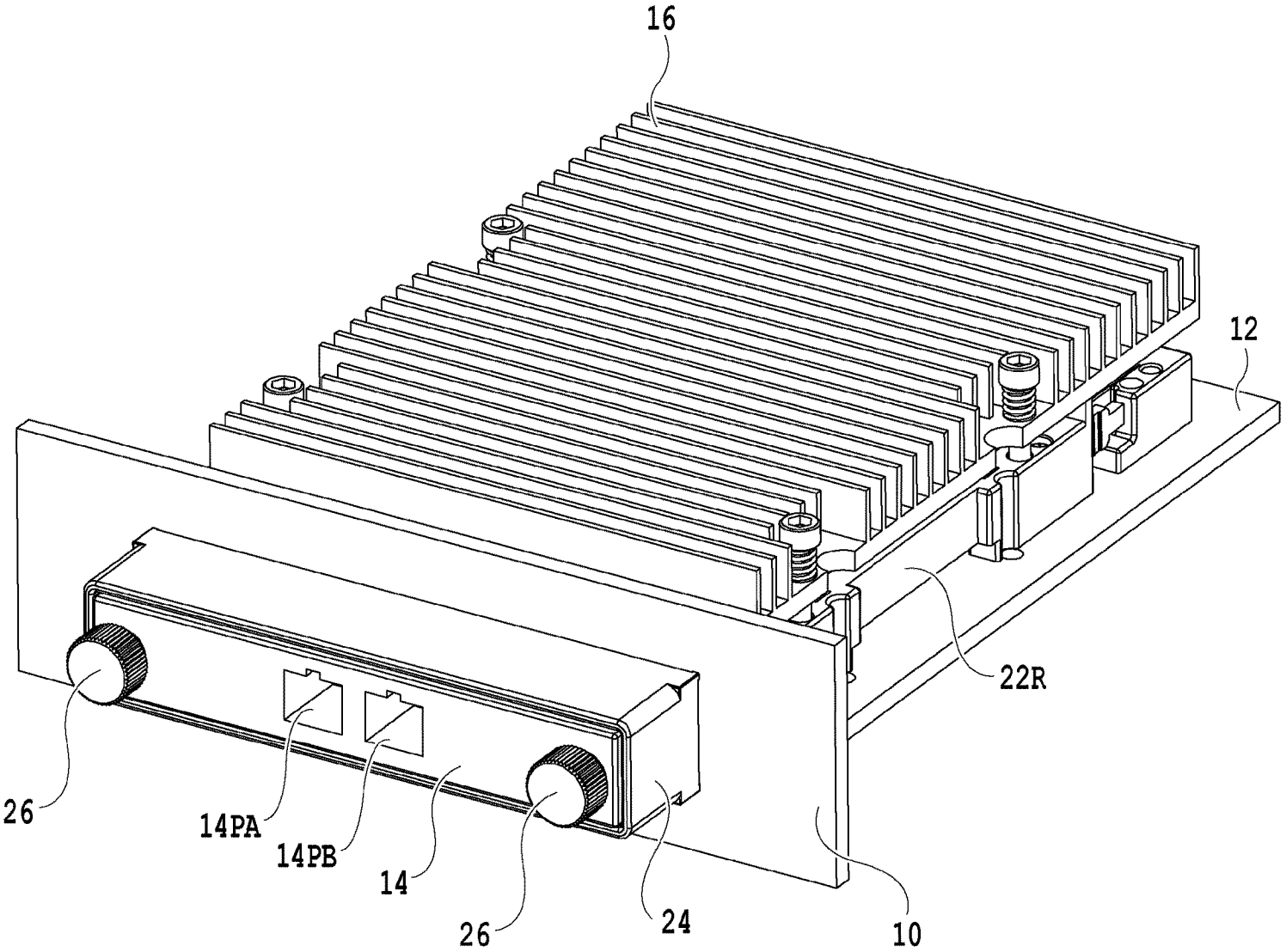
FIG. 5 is a perspective view showing a state in which the module is mounted to an example of a receptacle assembly according to the present invention.

FIG. 5 shows an example of a receptacle assembly according to the present invention together with a module. A plurality of receptacle assemblies shown in FIG. 5 are supported by and juxtaposed on a support panel 10 inside a given electronic device. Note that FIG. 5 representatively illustrates one of the receptacle assemblies supported by the support panel 10.

Figure 6:
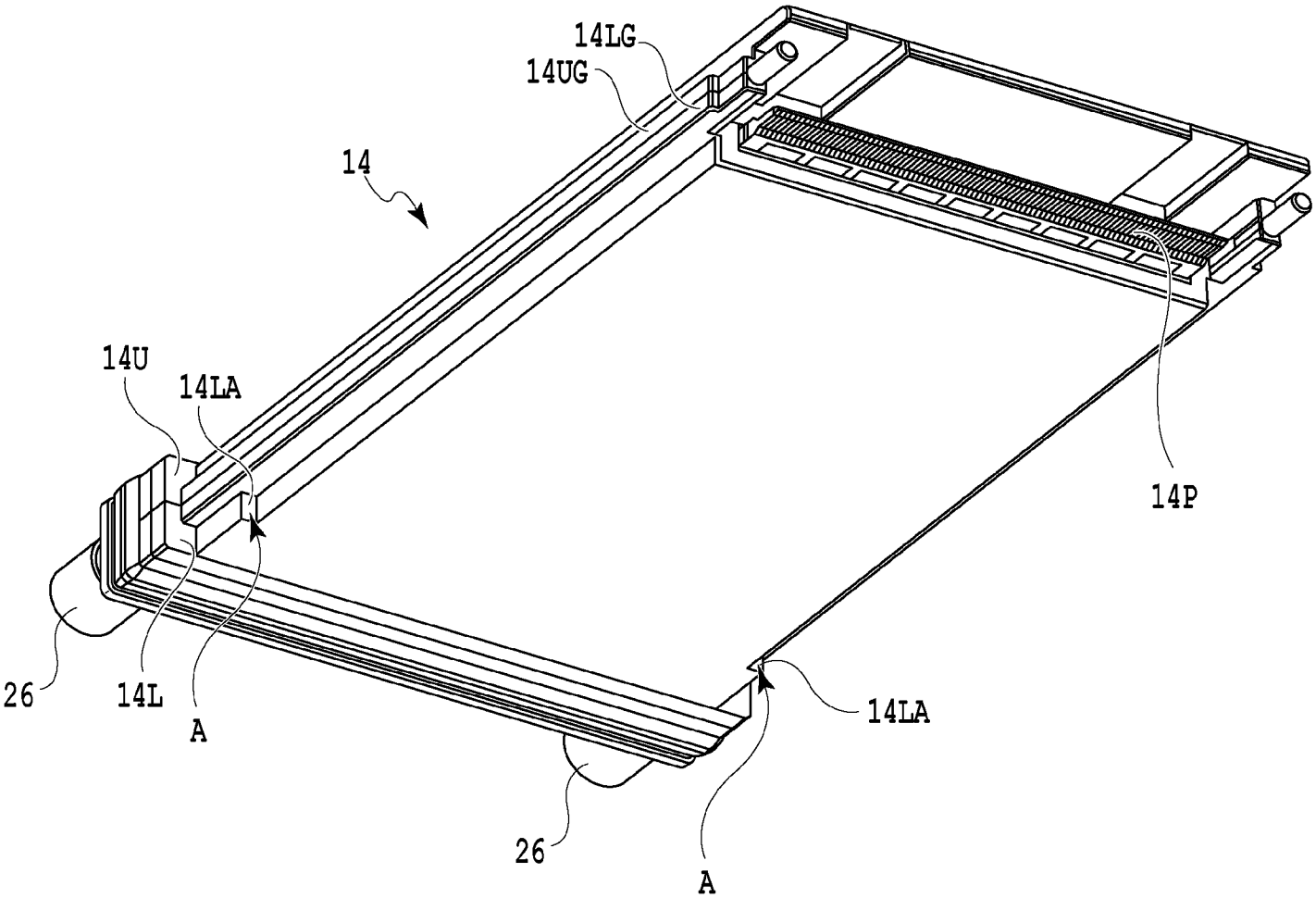
FIG. 6 is a perspective view showing appearance of an example of the module to be mounted to the example of the receptacle assembly illustrated in FIG. 5.
Figure 7:
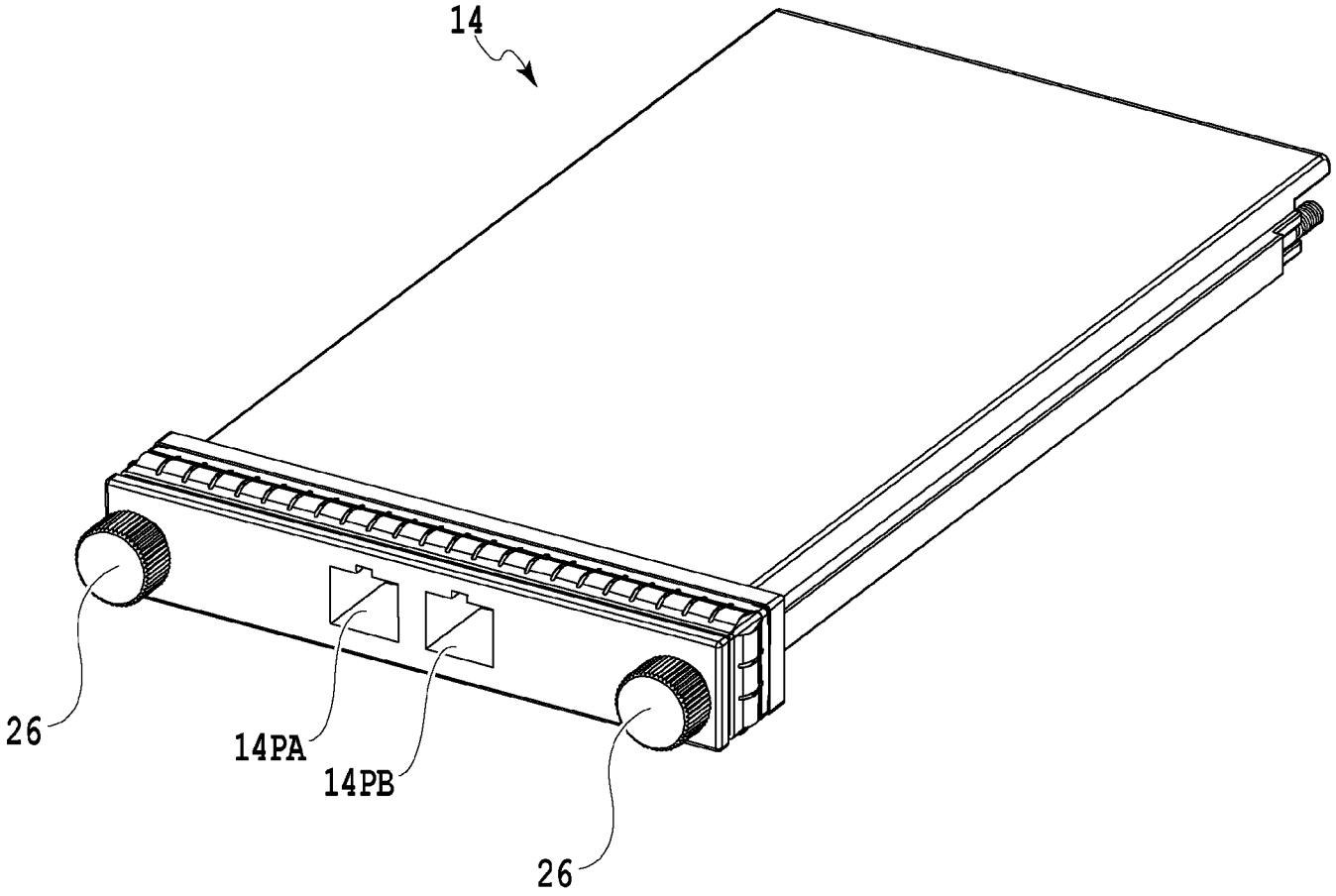
FIG. 7 is a perspective view showing appearance of the module illustrated in FIG. 6, which is viewed from one end side thereof.

An example of a transceiver module assembly includes a module 14 to be described later, and the receptacle assembly. As shown in FIGS. 6 and 7, the module 14 includes, as its main elements: an upper case 14U and a lower case 14L which are made of metal and collectively form a framework; and a module board to be positioned at a prescribed position in an accommodating space defined between the upper case 14U and the lower case 14L.

The upper case 14U as an upper member includes an opened lower end. A protection wall in the form of a thin plate being continuous with an upper surface and two side surfaces of the upper case 14U and projecting in a longitudinal direction thereof is formed at one end of the upper case 14U. The protection wall is configured to protect a plug connector 14P to be described later in case the module 14 is accidentally dropped.

Figure 1:
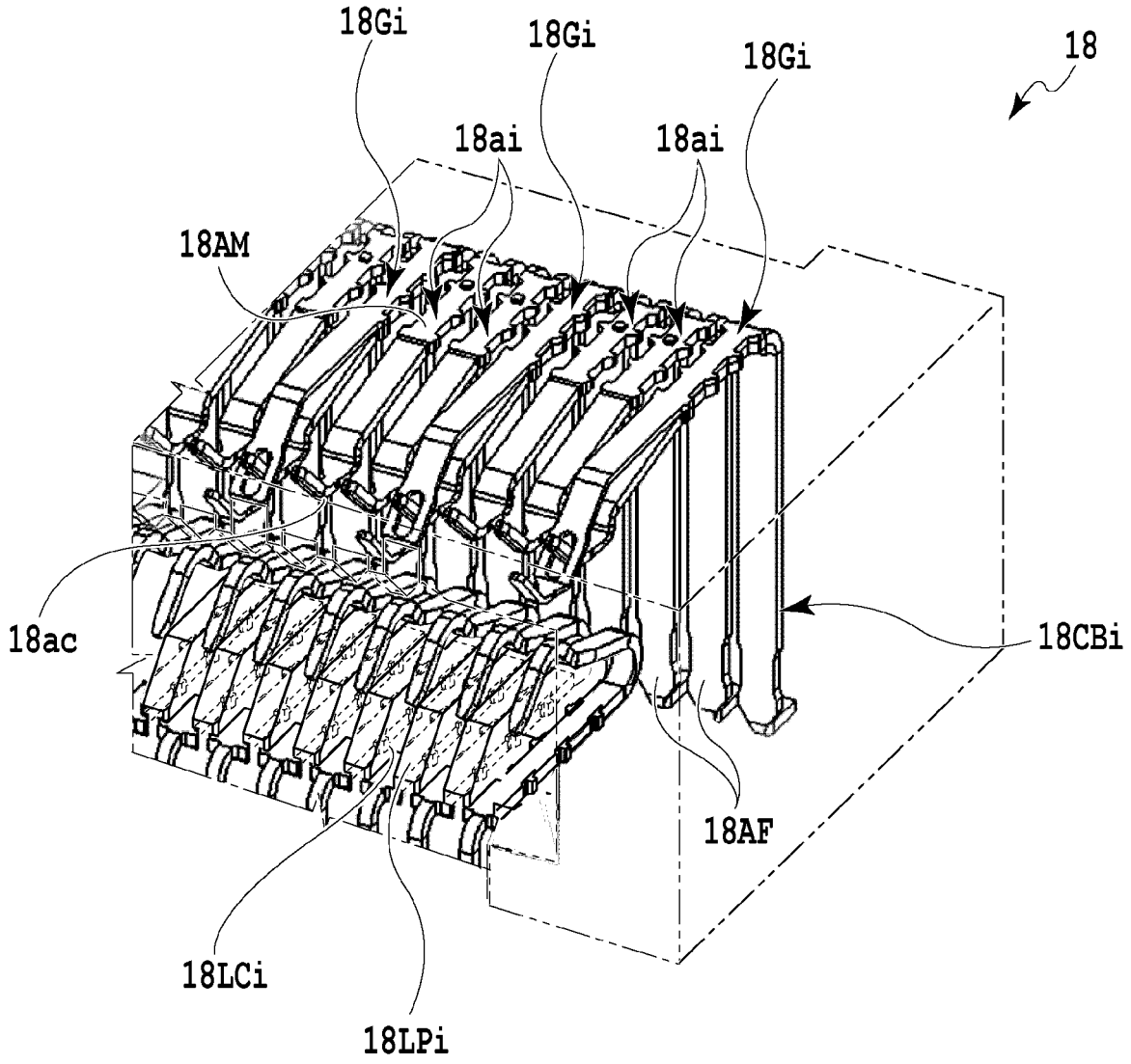
FIG. 1 is a perspective view showing partial enlarged essential parts of a first contact terminal group and of a second contact terminal group which are used in an example of a host connector according to the present invention.
Figure 2A:
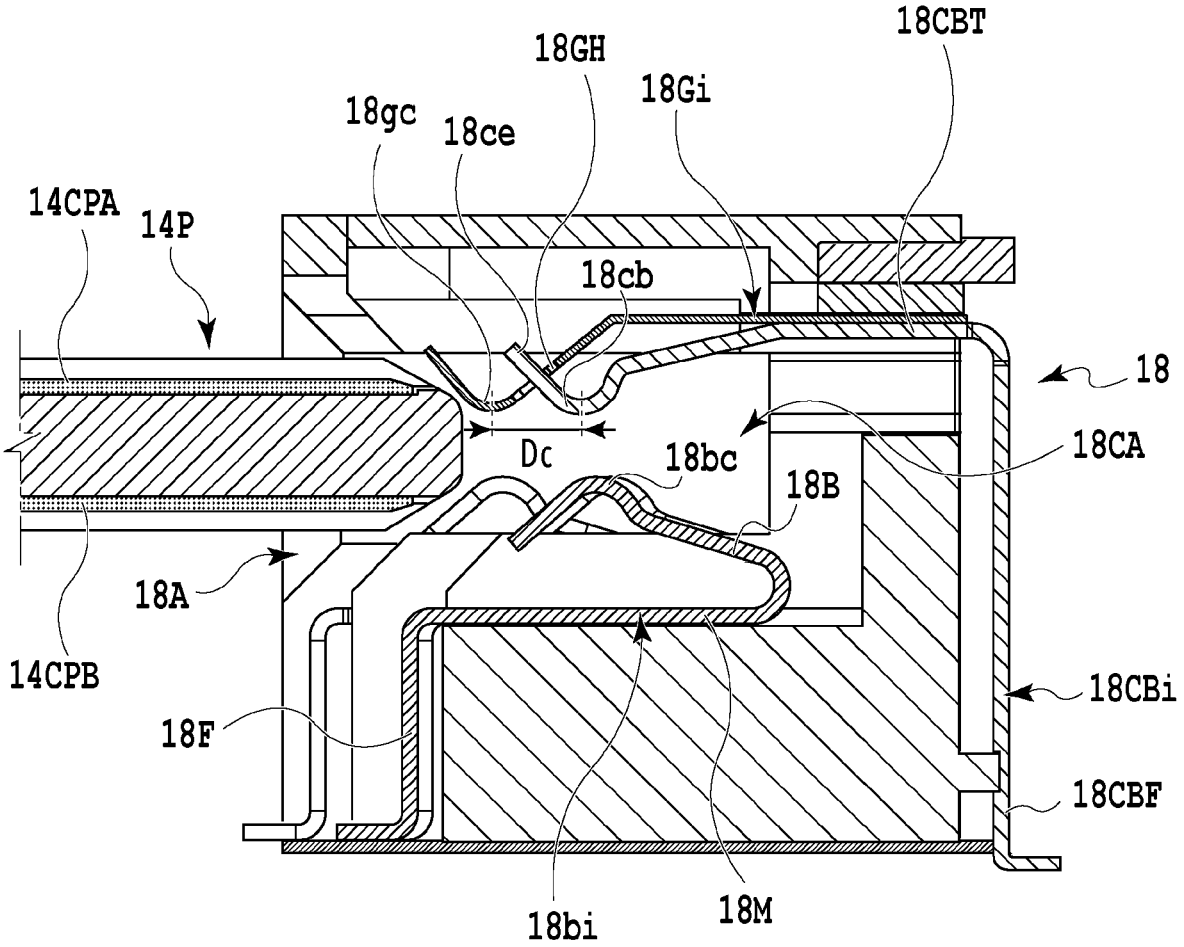
FIG. 2A is a cross-sectional view showing a configuration of the host connector illustrated in FIG. 1, together with part of a connection end of a module.

An electrode unit that constitutes the plug connector 14P as a connection end is provided to one end of the module board. As shown in FIG. 2A, a plurality of contact pads 14CPA and 14CPB are arranged parallel to one another and at predetermined intervals on common planes, respectively, on a top surface and a bottom surface of the electrode portion formed at a tip end of the plug connector 14P. Tip ends of the plurality of contact pads 14CPA and 14CPB are located on common straight lines extending along a direction of arrangement.

The lower case 14L as a lower member is fixed to a lower end of the above-described upper case 14U in such a way as to cover the opening at the lower end of the upper case 14U.

The above-described module board includes the plug connector 14P as the connection end. However, the present invention is not limited to this example. For instance, the module board may include card edge terminals as a connection end instead of the plug connector.

As shown in FIG. 7, an optical connector connected to one end of an optical cable (not shown) is connected to each of ports 14PA and 14PB provided at an end of the module 14. Another end of the optical cable is connected to an optical connector of another housing that constitutes a communication system which is not illustrated herein. Note that the ports of the module 14 are not limited only to the aforementioned example. For instance, such ports may be designed to be connected to a coaxial connector connected to a coaxial cable.

Fixing screws 26 used to fix the module 14 to a connector cover 20 to be described later penetrate through holes, which are formed at two side portions of the upper case 14U, along a longitudinal direction of the module 14, respectively. Tabs of the fixing screws 26 are exposed to an end surface of the module 14 where the ports 14PA and 14PB are open. A male screw portion to be threadedly engaged with a female screw portion of the connector cover 20 (see FIG. 8) is formed on a tip end of each fixing screw 26.

Projecting wall portions 14UG and 14LG that project sideways are formed on two side portions of the upper case 14U and the lower case 14L, respectively. The projecting wall portions 14UG and 14LG are designed to come into slidable contact with second dent portions (not shown) of a bracket 24 (see FIG. 8) to be described later. Moreover, an abutment surface portion 14LA is formed at an end of each projecting wall portion 14LG of the lower case 14L close to the tab of the corresponding fixing screw 26. In a case where the module 14 is connected to the receptacle assembly, portions A of the respective abutment surface portions 14LA of the lower case 14L come into contact with peripheral edges on two ends of first dent portions (not shown) of the bracket 24 to be described later.

Figure 8:
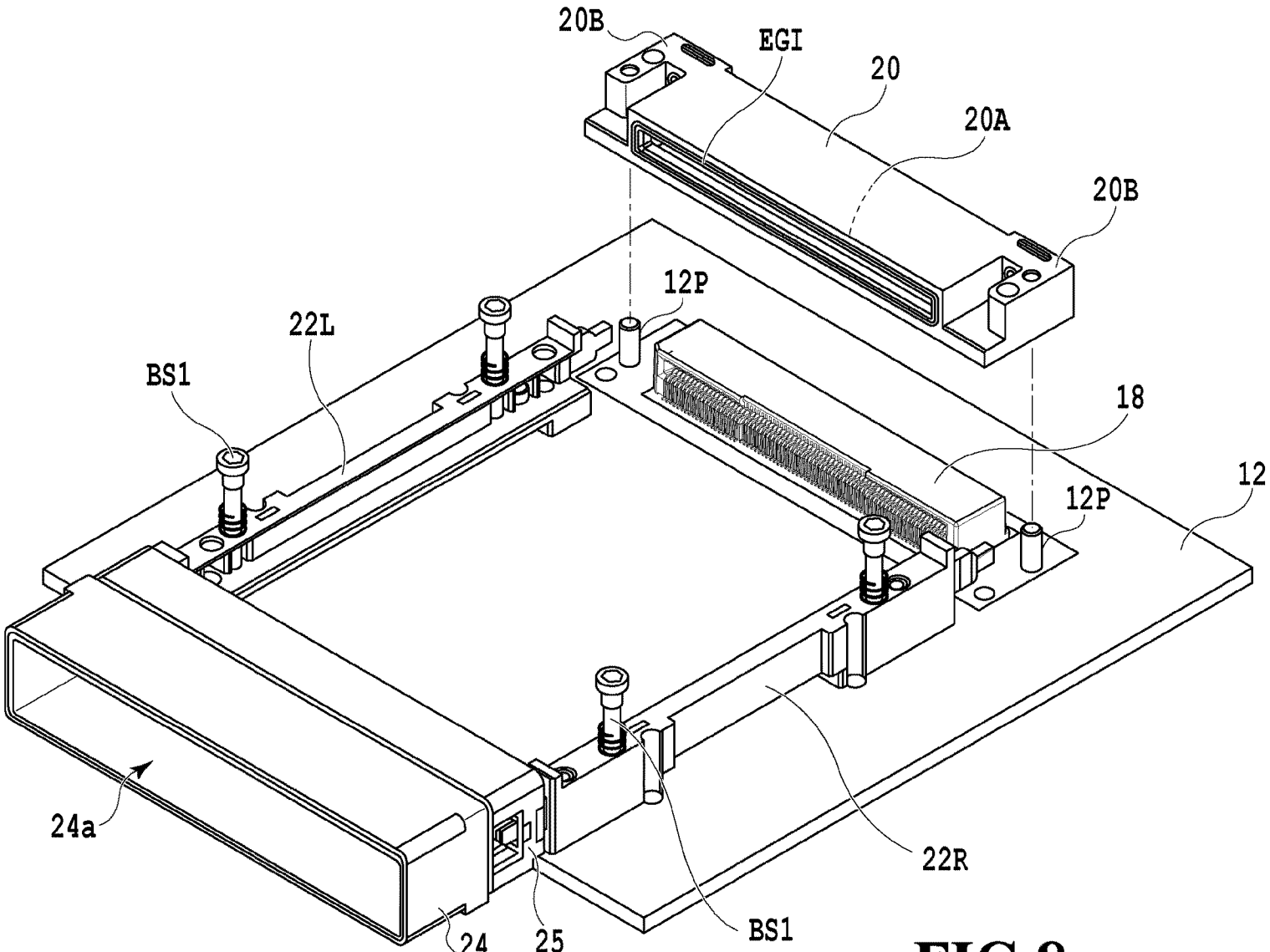
FIG. 8 is a perspective view schematically showing a configuration of the example of the receptacle assembly according to the present invention.

As shown in FIG. 8, the receptacle assembly is fixed to a printed wiring board 12. The receptacle assembly includes, as its main elements, the bracket 24 that guides the module 14 at the time of attachment and detachment of the module 14, a bracket supporting member 25 to which the bracket 24 is coupled, a pair of guide rail members 22R and 22L that form a module accommodating portion that detachably houses the module 14, a heatsink unit 16 (see FIG. 5) that dissipates heat generated from the module 14, a host connector 18 that electrically connects the contact pads of the plug connector 14P of the attached module 14 to conductive patterns on the printed wiring board 12, and the connector cover 20 that covers the host connector 18.

The bracket 24 includes a guide slot that penetrates a central part along short sides thereof. The guide slot includes a first hole portion 24*a* that allows insertion of the end of the module 14 where the above-described tabs of the fixing screws 26 are exposed, and a second hole portion (not shown) being continuous with the substantially rectangular first hole portion 24*a* and provided with a guide wall.

The first dent portions formed in the second hole portion are provided to correspond to a lower end that is continuous with the projecting wall portions 14LG of the lower case 14L of the module 14 mentioned above. The second dent portions formed in the second hole portion are provided to correspond to the respective projecting wall portions 14UG and 14LG of the upper case 14U and the lower case 14L of the module 14. The respective projecting wall portions 14UG and 14LG of the module 14 that pass through the second dent portions are brought into slidable contact with peripheral edges of the second dent portions. Through holes that allow insertion of small screws for fixing the bracket 24 to the bracket supporting member 25 are formed at four positions around the above-described second hole portion.

A guide slot corresponding to the second hole portion of the bracket 24 is provided on an inner side of the bracket supporting member 25.

The printed wiring board 12 includes a pair of holes to allow insertion of small screws for fixing the connector cover 20 to the printed wiring board 12, and positioning pins 12P, which are provided on both sides adjacent to the host connector 18. The host connector 18 is located between the positioning pins 12P. The host connector 18 is covered with the connector cover 20.

The connector cover 20 is made of a metallic material, for example. As shown in FIG. 8, the connector cover 20 includes a connector accommodating portion 20A and guide rail supporting portions 20B that are formed on both besides of the connector accommodating portion 20A to support one ends of the guide rail members 22R and 22L to be described later.

The connector accommodating portion 20A is provided with a slot that allows passage of the plug connector 14P of the module 14 at the time of attachment and detachment of the module 14 and designed to house the host connector 18 in the inside. Moreover, the connector accommodating portion 20A covers the entire host connector 18 with a given clearance in between.

The slot of the connector accommodating portion 20A is formed to face a slot 18A of the host connector 18. The female screw portions to be threadedly engaged with the male screw portions of the fixing screws 26 mentioned above are formed at two positions in the vicinity of two ends of a peripheral edge of the slot of the connector accommodating portion 20A. Moreover, a groove that allows insertion of an annular EMI gasket EG1 is formed around the peripheral edge of the slot. Furthermore, a groove that allows insertion of another annular EMI gasket (not shown) is formed in a lower end surface of the connector cover 20. The EMI gasket at the bottom is in contact with a mounting surface of the printed wiring board 12.

Accordingly, in the case where the plug connector 14P of the module 14 is connected to the host connector 18, the end surface of the module 14 where the plug connector 14P projects comes into contact with the EMI gasket EG1 on the peripheral edge of the slot of the connector cover 20, and the EMI gasket at the bottom is in contact with the mounting surface of the printed wiring board 12. As a consequence, noises generated inside the host connector 18 will be confined in the connector accommodating portion 20A.

Engagement portions (not shown) to be engaged with the one ends of the guide rail members 22R and 22L, respectively, are formed at positions of the guide rail supporting portions 20B adjacent to the female screw portions. Moreover, inside the respective guide rail supporting portions 20B, female screw holes (not shown) to be threadedly engaged with the small screws via holes in the printed wiring board 12 are formed in a direction substantially perpendicular to the mounting surface of the printed wiring board 12.

The guide rail member 22R as a guide member is made of a resin material, for example. As shown in FIG. 8, the guide rail member 22R includes a guide wall portion that guides and holds one side portion of the module 14. The guide wall portion includes protrusions located on two ends in its longitudinal direction, respectively, which are engaged with the above-described engagement portion of the guide rail supporting portion 20B and with an engagement portion of the bracket supporting member 25. A guide groove that guides and holds one of side portions of the module 14 is formed on an outer peripheral surface on one side of the guide wall portion along the longitudinal direction. Female screw holes are formed at two positions located away from each other on an upper part of the guide wall portion. A small screw BS1 for fixing the heatsink unit 16 (see FIG. 5) to the guide rail member 22R is screwed into each female screw hole. Protrusions for positioning the heatsink unit 16 relative to the guide rail member 22R are formed at positions adjacent to the respective female screw holes. A tip end of each protrusion is engaged with a relatively shallow positioning groove in the heatsink unit 16.

On the other hand, the guide rail member 22L as another guide member is made of a resin material, for example. As shown in FIG. 8, the guide rail member 22L includes a guide wall portion that guides and holds another side portion of the module 14. Note that the configuration of this guide wall portion is the same as the configuration of the aforementioned guide wall portion of the guide rail member 22R and an explanation thereof will be omitted. Thus, the module accommodating portion is formed on the printed wiring board 12 and between the guide rail member 22R and the guide rail member 22L.

Figure 2B:
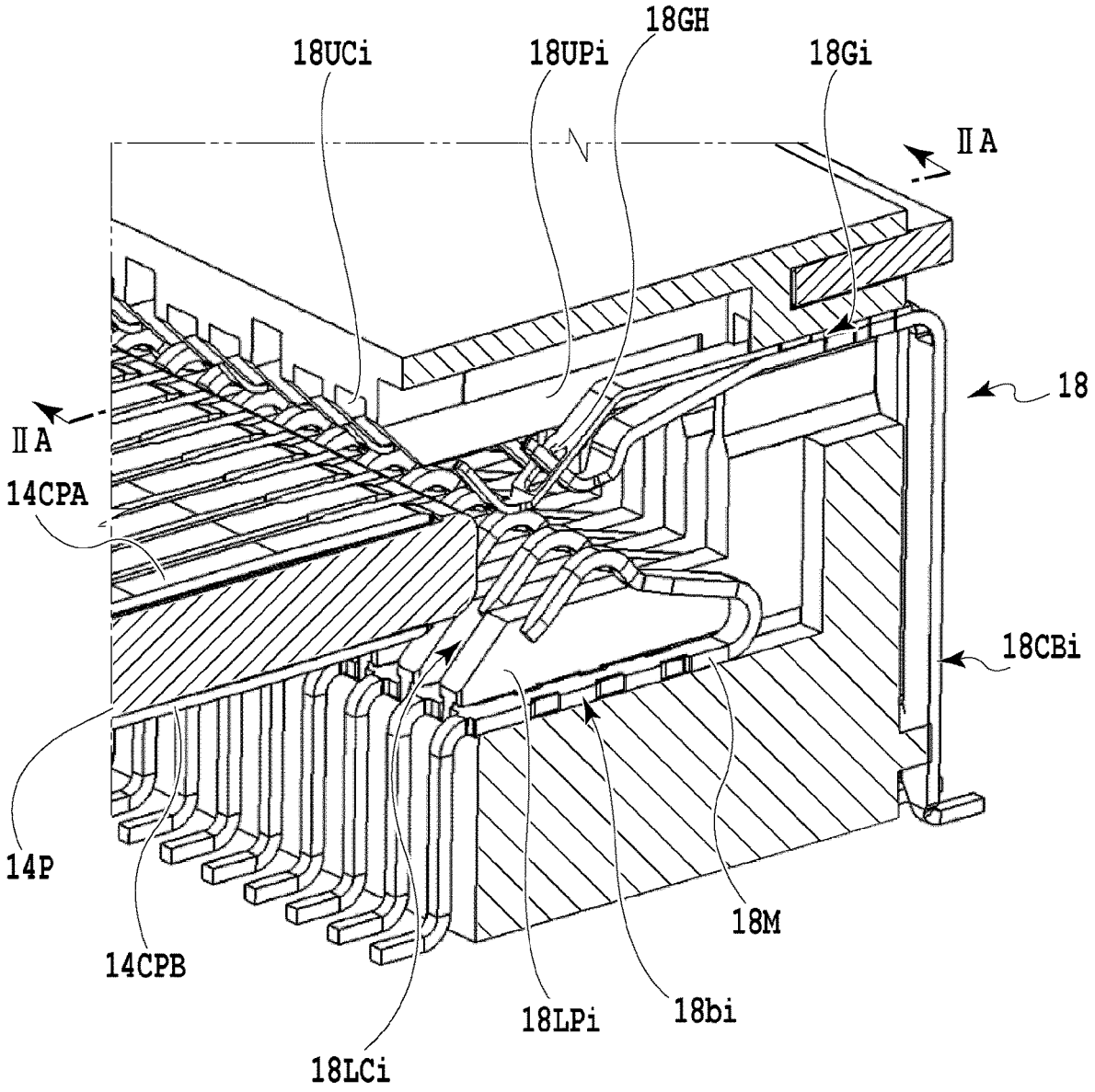
FIG. 2B is a perspective view showing a cross-section illustrated in FIG. 2A.
Figure 9:
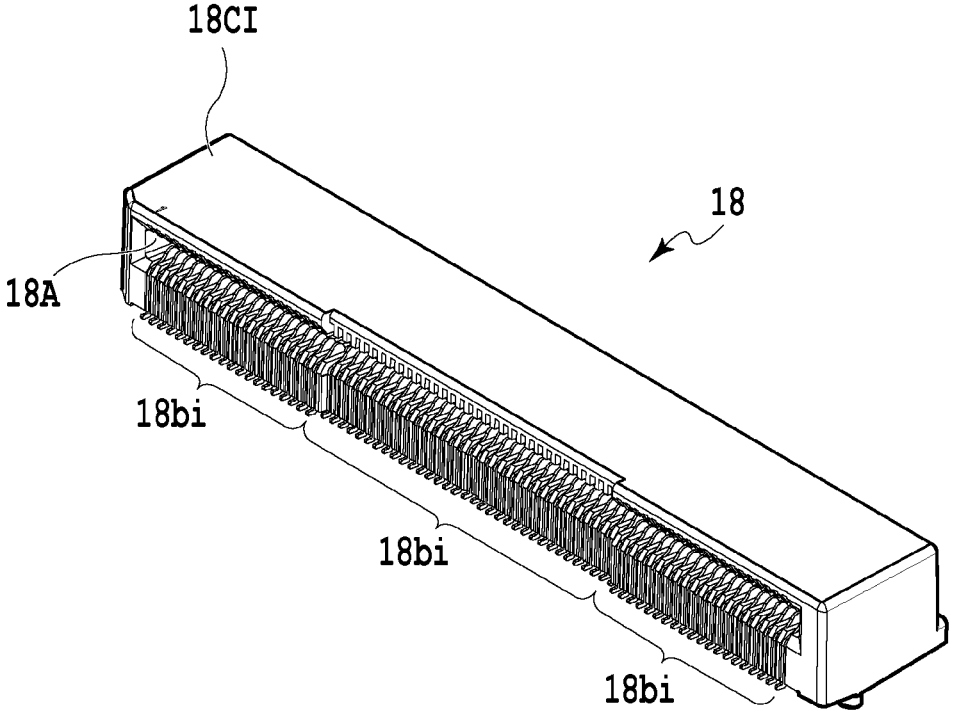
FIG. 9 is a perspective view showing appearance of the host connector used in the example of the receptacle assembly illustrated in FIG. 8.

As shown in the enlarged view of FIG. 9, the host connector 18 as an example of a host connector according to the present invention comprises: a connector insulator 18CI provided with the slot 18A into which the plug connector 14P of the module 14 is detachably inserted; a first contact terminal group formed from a plurality of contact terminals arranged inside the connector insulator 18CI and each brought into contact with one of contact pads 14CPA on one side at a connection end of the plug connector 14P; and a second contact terminal group formed from a plurality of contact terminals each brought into contact with one of contact pads 14CPB on another side that are opposed to the contact pads 14CPA on the one side as shown in FIGS. 2A and 2B.

The connector insulator 18CI is made of a resin material, for example, and comprises a front part provided with the slot 18A extending long and thin along a direction of arrangement of the aforementioned contact terminals, a rear part opposed to the front part, and an upper part and a lower part that connect both side wall portions that form both ends of the slot 18A.

A plurality of slits 18UCi and 18LCi (i=1 to n where n is a positive integer) are formed at given intervals in the direction of arrangement of the contact terminals, that is, in the longitudinal direction at a peripheral edge of the slot 18A at the front part (see FIG. 2B).

The plurality of slits 18UCi and 18LCi are formed at inner peripheral portions of the upper part and the lower part, respectively, in such a way as to face one another. Each slit 18UCi and the corresponding slit 18LCi communicate with each other.

The adjacent slits 18UCi are partitioned by partition walls 18UPi (i=1 to n where n is a positive integer). Moreover, the adjacent slits 18LCi are partitioned by partition walls 18LPi (i=1 to n where n is a positive integer).

As shown in FIGS. 2A and 9, the positions of front ends of the plurality of partition walls 18LPi that form a peripheral edge at a substantially central part of the slot 18A of the connector insulator 18CI are located closer to the rear part than are the positions of front ends of the plurality of partition walls 18LPi that form the remaining portions of the peripheral edge of the slot 18A.

The first contact terminal group and the second contact terminal group are configured to cooperatively sandwich the plug connector 14P of the module 14 inserted into a connection end accommodating portion 18CA of the connector insulator 18CI through the slot 18A, and to establish electrical connection to an electrode group to be connected to the conductive patterns on the printed wiring board 12 where the receptacle assembly is disposed.

As shown in FIG. 2A, the first contact terminal group comprises a plurality of grounding sub-contact terminals 18Gi (i=1 to n where n is a positive integer) arranged inside the respective slits 18UCi of the connector insulator 18CI, grounding main contact terminals 18CBi (i=1 to n where n is a positive integer) that support the grounding sub-contact terminals 18Gi, and a plurality of signal contact terminals 18*ai* (i=1 to n where n is a positive integer).

In order to reduce crosstalk between the adjacent channels, the grounding sub-contact terminals 18Gi and the grounding main contact terminals 18CBi are arranged on both besides of a pair of the signal contact terminals 18*ai*, respectively.

Herewith, the first contact terminal group includes the terminals repeatedly arranged from one end to another end of the connector insulator 18CI in order of the grounding sub-contact terminal 18Gi (G) and the grounding main contact terminal 18CBi (G), the signal contact terminal 18*ai* (S), the signal contact terminal 18*ai* (S), the grounding sub-contact terminal 18Gi (G) and the grounding main contact terminal 18CBi (G), G, S, S, G, and so on.

Each signal contact terminal 18*ai* comprises a movable piece portion 18AM provided with a downward convex contact portion 18*ac* and brought into contact with the corresponding contact pad 14CPA, and a fixed terminal portion 18AF that is continuous with an end of the movable piece portion 18AM and bent in such a way as to be perpendicular to a surface of the printed wiring board 12.

Each grounding main contact terminal 18CBi comprises a movable piece portion 18CBT provided with a contact portion 18*cb* brought into contact with the corresponding contact pad 14CPA, and a fixed terminal portion 18CBF that is continuous with an end of the movable piece portion 18CBT and bent in such a way as to be perpendicular to the surface of the printed wiring board 12. One end of the fixed terminal portion 18CBF is fixed by soldering to the corresponding conductive pattern on the printed wiring board 12 located at the rear part of the connector insulator 18CI. A length of the fixed terminal portion 18CBF is set substantially equal to a length of the fixed terminal portion 18AF of the signal contact terminal 18*ai* mentioned above. An extending portion 18*ce* of the downward convex contact portion 18*cb* penetrates a slit 18GH of the grounding sub-contact terminal 18Gi to be described later, and extends obliquely upward in the direction of the slot 18A.

Each grounding sub-contact terminal 18Gi includes a movable piece portion having a downward convex contact portion 18*gc* provided on another end, which is brought into contact with the shared contact pad 14CPA mentioned above. One end of the movable piece portion is joined in an overlapping manner to an upper surface of an end of the movable piece portion 18CBT of the corresponding grounding main contact terminal 18CBi. Such joining process may adopt a method such as spot welding or thermal compression bonding, for example.

The other end of the movable piece portion extends toward the slot 18A and is bent obliquely downward. A bent part of the other end of the movable piece portion has the slit 18GH that allows penetration of the extending portion 18*ce* of the contact portion 18*cb* of the corresponding grounding main contact terminal 18CBi. A length of the movable piece portion in a direction of attachment and detachment of the connection end of the plug connector 14P is set larger than a length of the movable piece portion 18CBT of the grounding main contact terminal 18CBi.

Hereby, the position of the contact portion 18*gc* of the movable piece portion is located closer to the slot 18A than is the position of the contact portion 18*cb* of the movable piece portion 18CBT of each grounding main contact terminal 18CBi. As shown in FIG. 2A, a center-to-center distance Dc between the contact portion 18*gc* and the contact portion 18*cb* to be brought into contact with different locations on the same contact pad is set in a range from about 1.1 mm to 1.5 mm inclusive, for example.

The second contact terminal group comprises a plurality of grounding contact terminals 18*bi* (i=1 to n where n is a positive integer) arranged inside the respective slits 18LCi of the connector insulator 18CI, a plurality of signal contact terminals, and a plurality of power supply contact terminals. Since the grounding contact terminals, the signal contact terminals, and the power supply contact terminals have the same shape with respect to each other, a structure of the grounding contact terminals 18*bi* will be described below while omitting explanations of the signal contact terminals and the power supply contact terminals. Note that signals to be transmitted through the signal contact terminals are assumed to be signals in a lower frequency band than signals in a high-frequency band to be transmitted through the above-described signal contact terminals 18*ai*.

Each grounding contact terminal 18*bi* comprises a movable piece portion 18B provided with a upward convex contact portion 18*bc* brought into contact with the corresponding contact pad 14CPB on the other side at the connection end of the plug connector 14P, and a fixed terminal portion 18M that is continuous with an end of the movable piece portion 18B and is bent after extending toward the slot 18A substantially in parallel to the surface of the printed wiring board 12. A terminal 18F of the fixed terminal portion 18M folded along a front end of the corresponding partition wall 18LPi is fixed by soldering to the corresponding conductive pattern on the printed wiring board 12.

The contact portions 18*gc* of the grounding sub-contact terminals 18Gi, the contact portions 18*bc* of the grounding contact terminals 18*bi*, the power supply contact terminals, and contact portions of the signal contact terminals are arranged to face one another. Moreover, the contact portions 18*cb* of the grounding main contact terminals 18CBi, the contact portions 18*bc* of the grounding contact terminals 18*bi*, the power supply contact terminals, and the contact portions of the signal contact terminals are arranged to face one another.

Figure 3A:
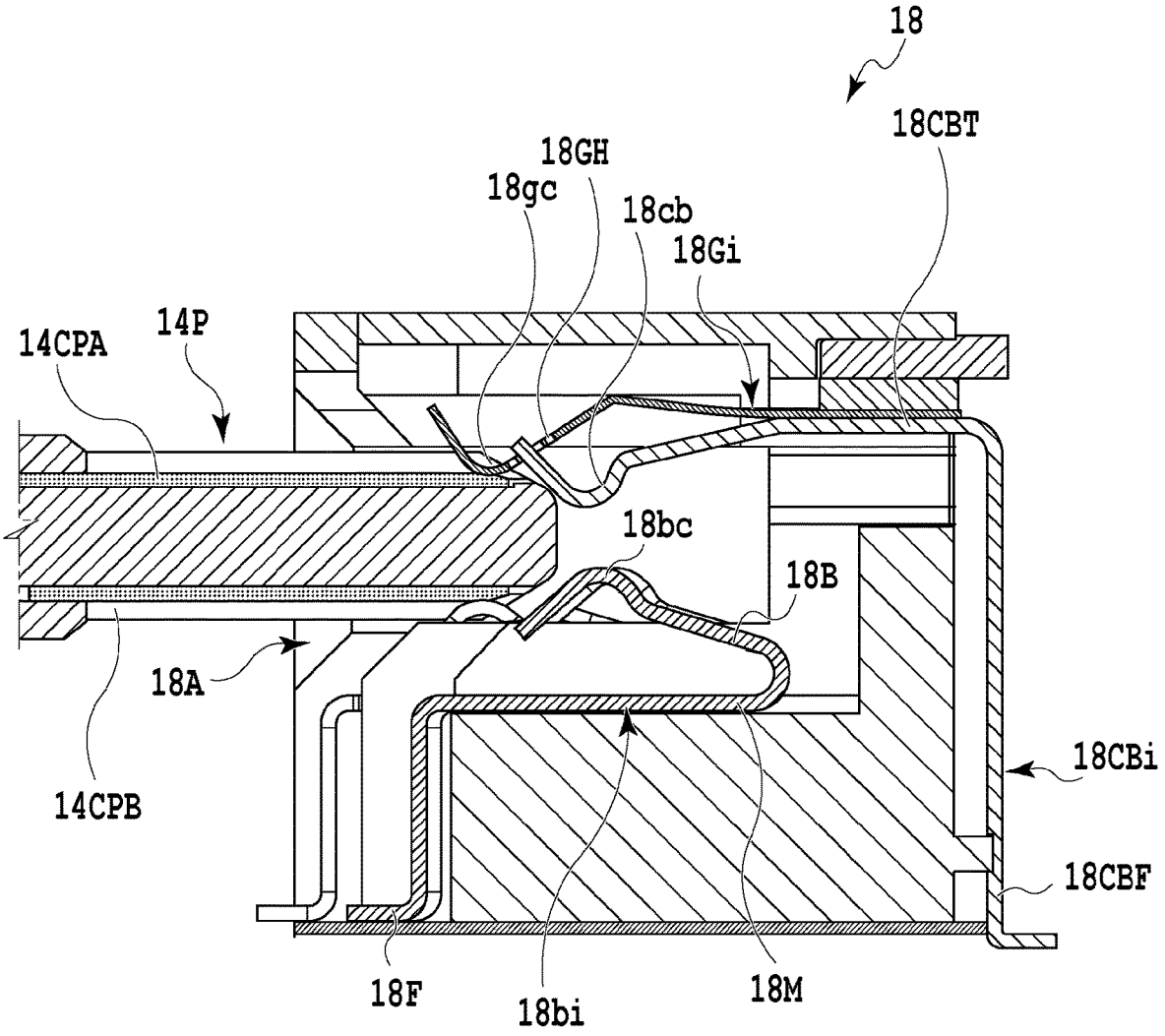
FIG. 3A is a cross-sectional view made available for an explanation of an inserting operation of the connection end of the module relative to the first contact terminal group and the second contact terminal group in the host connector illustrated in FIG. 2A.
Figure 3B:
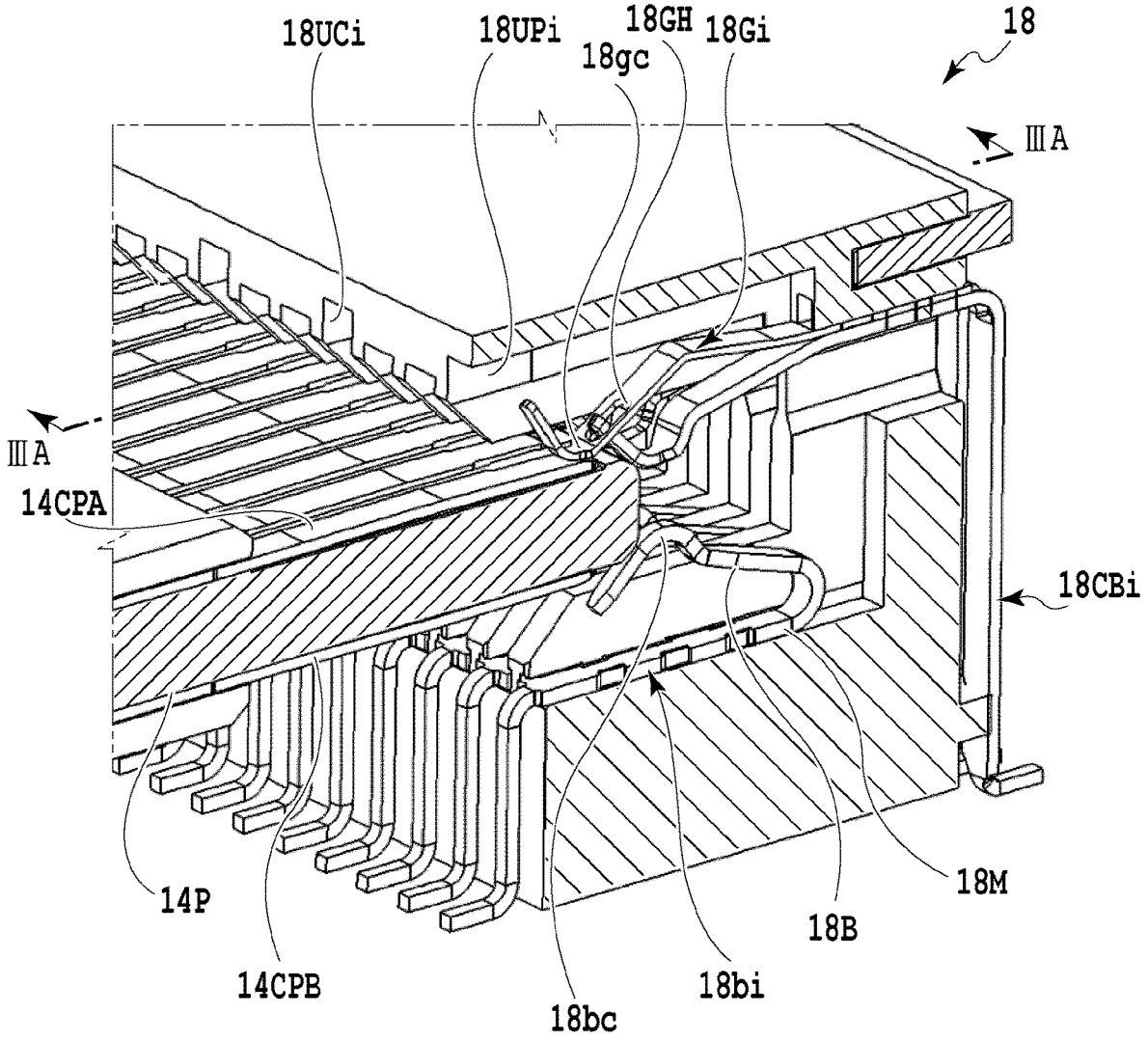
FIG. 3B is a perspective view showing a cross-section illustrated in FIG. 3A.
Figure 4A:
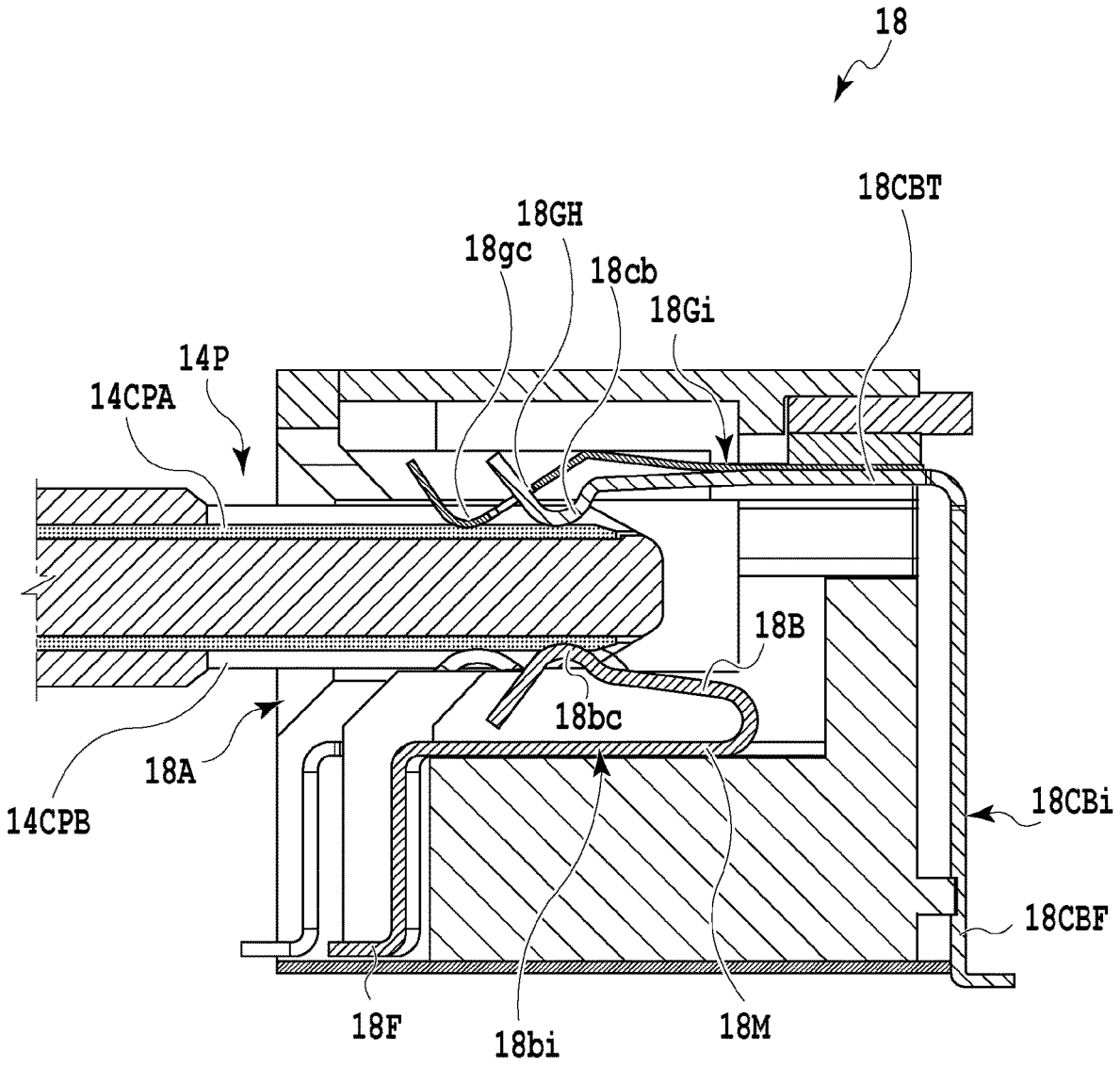
FIG. 4A is a cross-sectional view made available for an explanation of an inserting operation of the connection end of the module relative to the first contact terminal group and the second contact terminal group in the host connector illustrated in FIG. 2A.
Figure 4B:
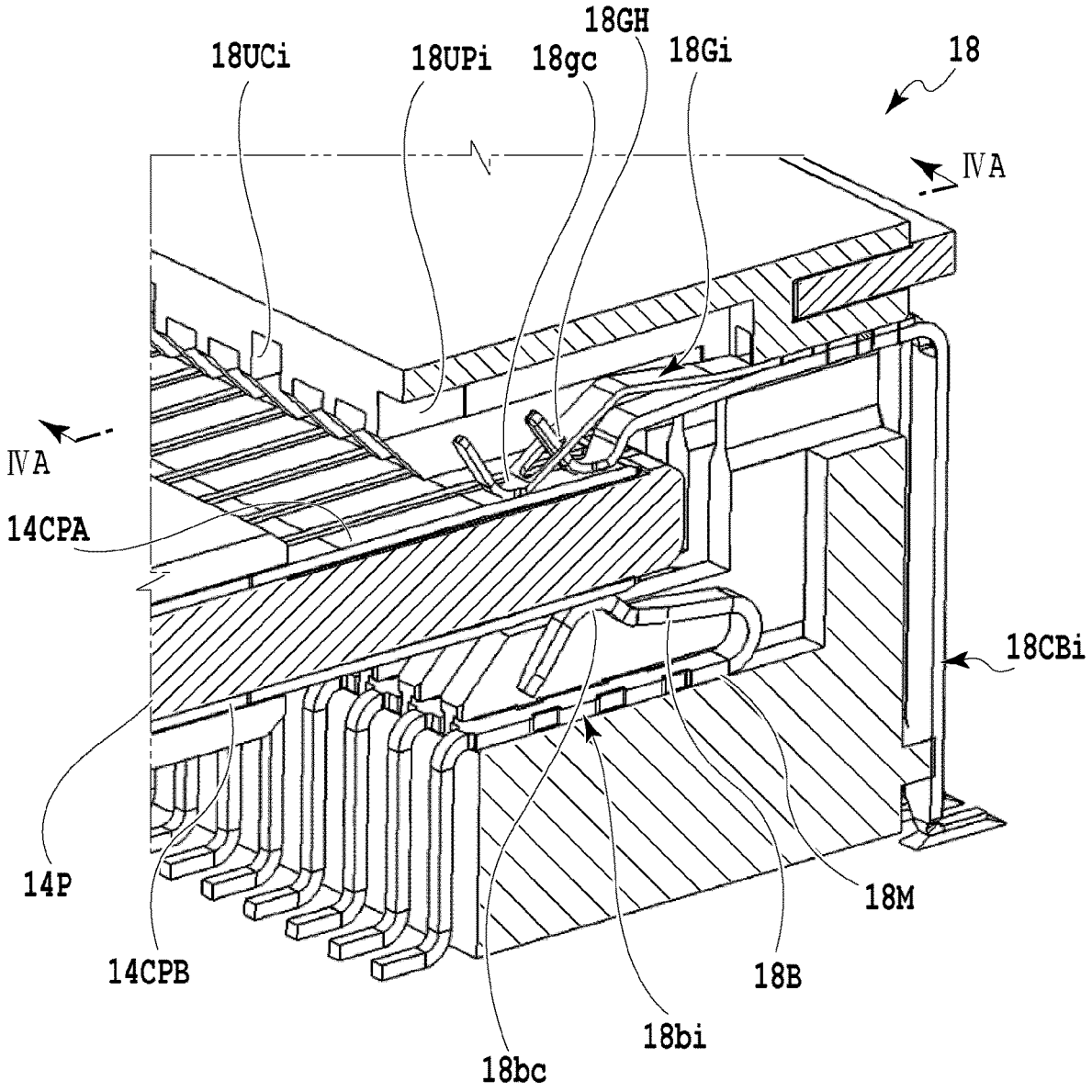
FIG. 4B is a perspective view showing a cross-section illustrated in FIG. 4A.

In the case where the plug connector 14P of the module 14 is connected to the host connector 18 in the above-described configuration, the tip end of the plug connector 14P is first inserted into the slot 18A of the connector insulator 18CI in such a way as to be substantially parallel to the surface of the printed wiring board 12 as shown in FIGS. 2A and 2B. Then, the tip end of the plug connector 14P is positioned between the contact portions 18*gc* of the grounding sub-contact terminals 18Gi as well as the contact portions of the signal contact terminals 18*ai* and the contact portions 18*bc* of the grounding contact terminals 18*bi* as well as the contact portions of the signal contact terminals and is further forced into as shown in FIGS. 3A and 3B. Herewith, the contact portions 18*gc* of the grounding sub-contact terminals 18Gi are first brought into slidable contact with the contact pads 14CPA. Subsequently, the contact portions 18*cb* of the grounding main contact terminals 18CBi are brought into slidable contact with the contact pads 14CPA as shown in FIGS. 4A and 4B. Accordingly, each contact portion 18*gc* of the grounding sub-contact terminal 18Gi and each contact portion 18*cb* of the grounding main contact terminal 18CBi are positioned at different locations on the same contact pad 14CPA. Moreover, the contact portions 18*ac* of the plurality of signal contact terminals 18*ai* disposed between the grounding sub-contact terminals 18Gi are brought into slidable contact with the contact pads 14CPA, respectively.

At that time, the contact portions 18*bc* of the grounding contact terminals 18*bi* are brought into slidable contact with the contact pads 14CPB of the plug connector 14P while the signal contact terminals and the power supply contact terminals are brought into slidable contact.

In the case where signals in a high-frequency band such as signals at 100 KHz or above, for example are transmitted through the signal contact terminals 18*ai* in the state where the plug connector 14P of the module 14 is connected to the host connector 18 as described above, crosstalk will not be increased and frequency characteristics will not be deteriorated because the contact portions 18*cb* of the grounding main contact terminals 18CBi and the contact portions of the signal contact terminals 18*ai* having the same shape to each other are arranged on a common straight line extending along the direction of arrangement of the contact terminals and the plurality of signal contact terminals 18*ai* are disposed between the grounding main contact terminals 18CBi. Such unique effects have been verified from results obtained by a given simulator conducted by the inventor of the present application.

Figure 10A:
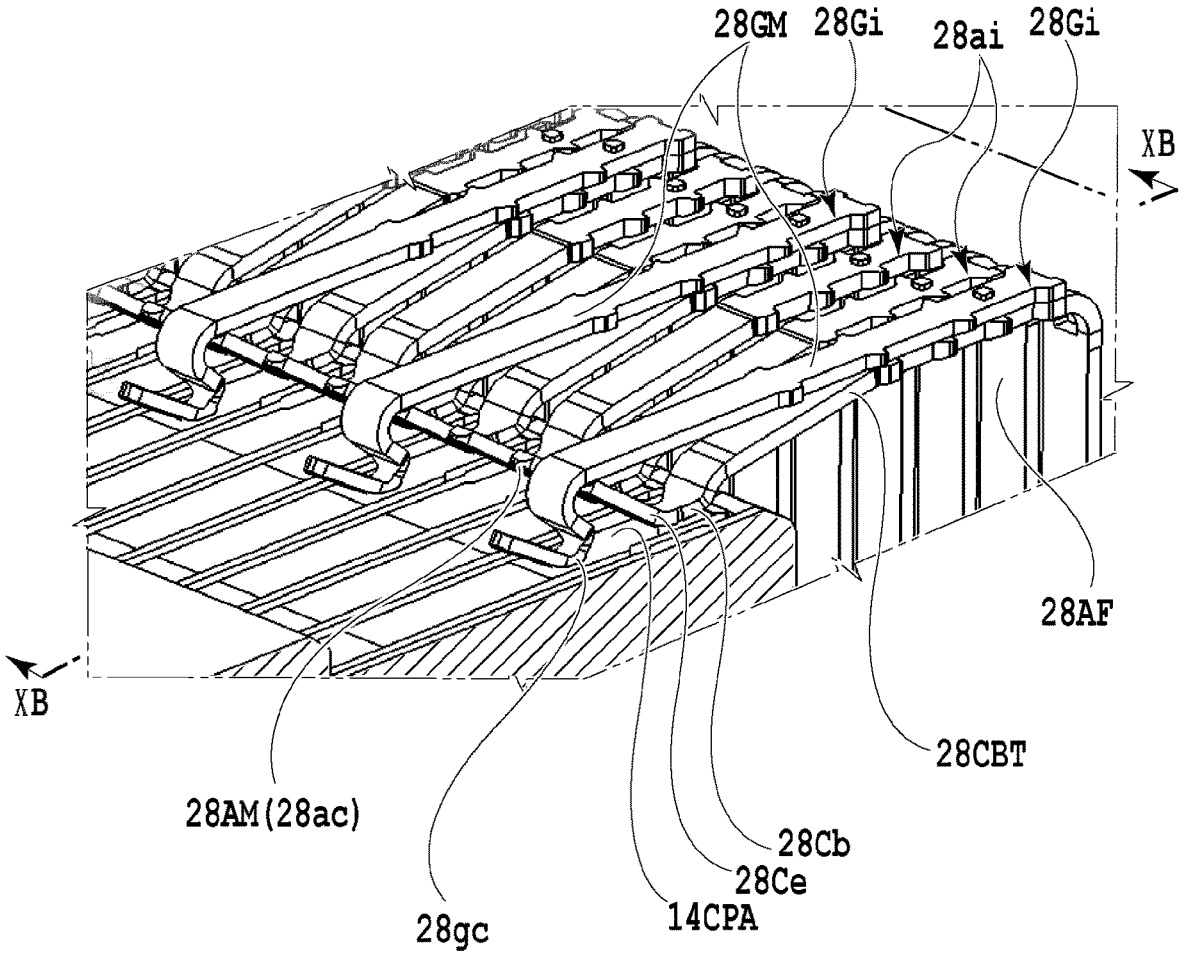
FIG. 10A is a perspective view showing partial enlarged essential parts of a first contact terminal group and of a second contact terminal group which are used in another example of the host connector according to the present invention.
Figure 10B:
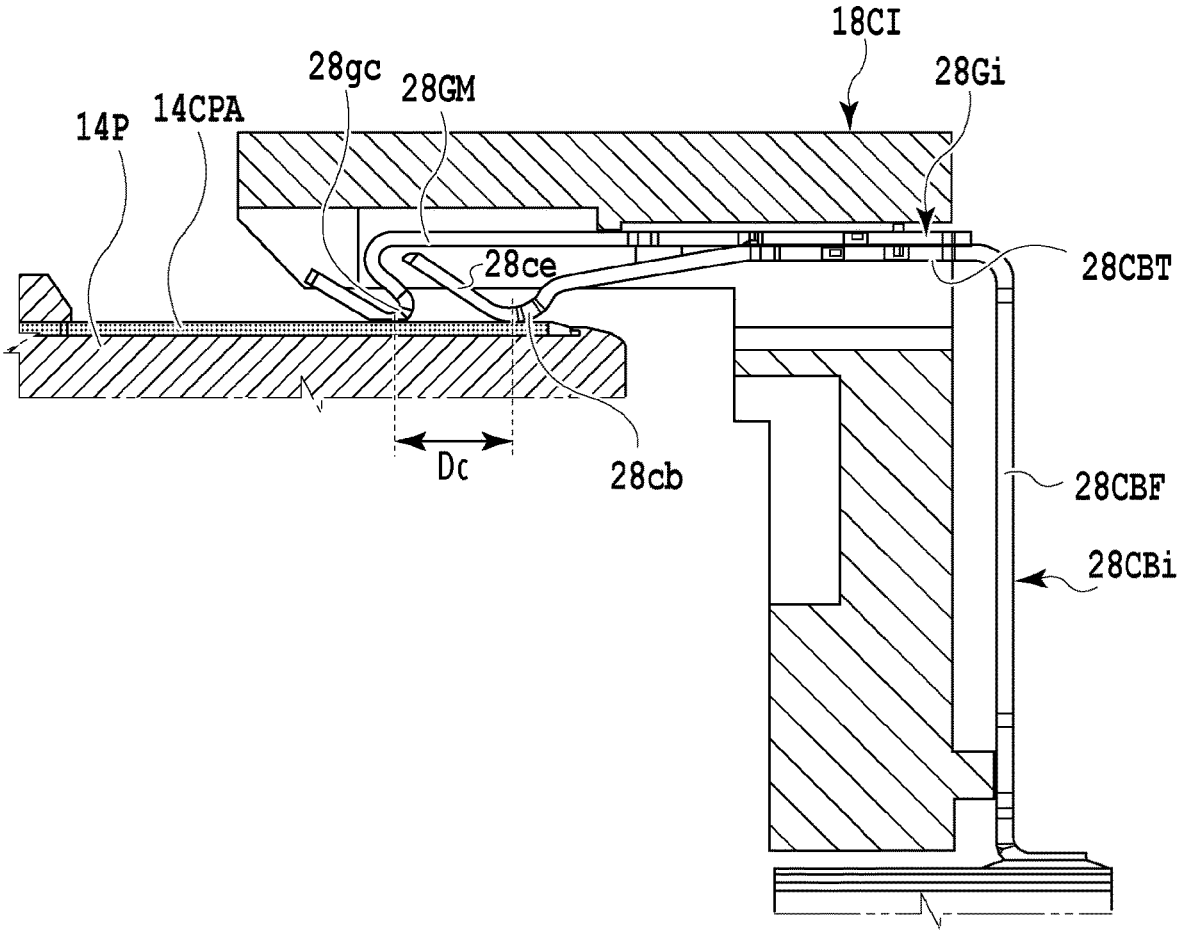
FIG. 10B is a configuration diagram schematically showing a grounding main contact terminal and a grounding sub-contact terminal which constitute part of the first contact terminal group illustrated in FIG. 10A, together with part of a connection end of a module.

FIGS. 10A and 10B show essential parts of a first contact terminal group used in another example of the host connector according to the present invention.

In FIGS. 10A and 10B, the host connector comprises: the connector insulator 18CI provided with the slot 18A into which the plug connector 14P of the module 14 described above is detachably inserted; the first contact terminal group formed from the plurality of contact terminals arranged inside the connector insulator 18CI and each brought into contact with the corresponding contact pad 14CPA on the one side at the connection end of the plug connector 14P; and the second contact terminal group formed from the plurality of contact terminals each brought into contact with the corresponding contact pad 14CPB on the other side which is opposed to the contact pad 14CPA.

Note that structures of the connector insulator 18CI and the second contact terminal group in the example shown in FIGS. 10A and 10B are the same as the structures of the connector insulator 18CI and the second contact terminal group in the example shown in FIG. 2A, and overlapping explanations thereof will be omitted.

As shown in FIGS. 10A and 10B, the first contact terminal group comprises a plurality of grounding sub-contact terminals 28Gi (i=1 to n where n is a positive integer) arranged inside the respective slits 18UCi of the connector insulator 18CI, grounding main contact terminals 28CBi (i=1 to n where n is a positive integer) that support the grounding sub-contact terminals 28Gi, and a plurality of signal contact terminals 28*ai* (i=1 to n where n is a positive integer).

In order to reduce crosstalk between the adjacent channels, the grounding sub-contact terminals 28Gi and the grounding main contact terminals 28CBi are arranged on both besides of a pair of the signal contact terminals 28*ai*, respectively.

Hereby, the first contact terminal group includes the terminals repeatedly arranged from one end to the other end of the connector insulator 18CI in order of the grounding sub-contact terminal 28Gi (G) and the grounding main contact terminal 28CBi (G), the signal contact terminal 28*ai* (S), the signal contact terminal 28*ai* (S), the grounding sub-contact terminal 28Gi (G) and the grounding main contact terminal 28CBi (G), G, S, S, G, and so on.

Each signal contact terminal 28*ai* comprises a movable piece portion 28AM provided with a contact portion 28*ac* brought into contact with the corresponding contact pad 14CPA, and a fixed terminal portion 28AF that is continuous with an end of the movable piece portion 28AM and bent in such a way as to be perpendicular to the surface of the printed wiring board 12.

Each grounding main contact terminal 28CBi comprises a movable piece portion 28CBT provided with a downward convex contact portion 28*cb* and brought into contact with the corresponding contact pad 14CPA, and a fixed terminal portion 28CBF that is continuous with an end of the movable piece portion 28CBT and bent in such a way as to be perpendicular to the surface of the printed wiring board 12. One end of the fixed terminal portion 28CBF is fixed by soldering to the corresponding conductive pattern on the printed wiring board 12 located at the rear part of the connector insulator 18CI. A length of the fixed terminal portion 28CBF is set substantially equal to a length of the fixed terminal portion 28AF of the signal contact terminal 28*ai* mentioned above. An extending portion 28*ce* of the contact portion 28*cb* extends obliquely upward in the direction of the slot 18A so as to be located on an inner side of a first bent portion of the corresponding grounding sub-contact terminal 28Gi to be described later.

Each grounding sub-contact terminal 28Gi has a movable piece portion having a downward convex contact portion 28*gc* provided on another end, which is brought into contact with the shared contact pad 14CPA mentioned above. One end of the movable piece portion is joined in an overlapping manner to an upper surface of an end of the movable piece portion 28CBT of the corresponding grounding main contact terminal 28CBi. Such joining process may adopt a method such as spot welding or thermal compression bonding, for example.

As shown in FIG. 10B, the other end of the movable piece portion has the first bent portion that extends toward the slot 18A and is bent obliquely downward to the left. A second bent portion being continuous with the first bent portion at the other end of the movable piece portion mentioned above and extending obliquely upward to the slot 18A has a downward convex contact portion 28*gc*. A length of the movable piece portion in the direction of attachment and detachment of the connection end of the plug connector 14P is set larger than a length of the movable piece portion 28CBT of the grounding main contact terminal 28CBi.

Hereby, the position of the contact portion 28*gc* of the movable piece portion is located closer to the slot 18A than is the position of the contact portion 28*cb* of the movable piece portion 28CBT of each grounding main contact terminal 28CBi. As shown in FIG. 10B, a center-to-center distance Dc between the contact portion 28*gc* and the contact portion 28*cb* to be brought into contact with different locations on the same contact pad is set in a range from about 1.1 mm to 1.5 mm inclusive, for example.

In the case where signals in a high-frequency band such as signals at 100 KHz or above, for example are transmitted through the signal contact terminals 28*ai* in the state where the plug connector 14P of the module 14 is connected to the host connector 18 as described above, crosstalk will not be increased and frequency characteristics will not be deteriorated because the contact portions 28*cb* of the grounding main contact terminals 28CBi and the contact portions of the signal contact terminals 28*ai* having the same shape with respect to each other are arranged on a common straight line extending along the direction of arrangement of the contact terminals and the plurality of signal contact terminals 28*ai* are disposed between the grounding main contact terminals 28CBi. Such unique effects have been verified from results obtained by a given simulator conducted by the inventor of the present application.

Figure 11A:
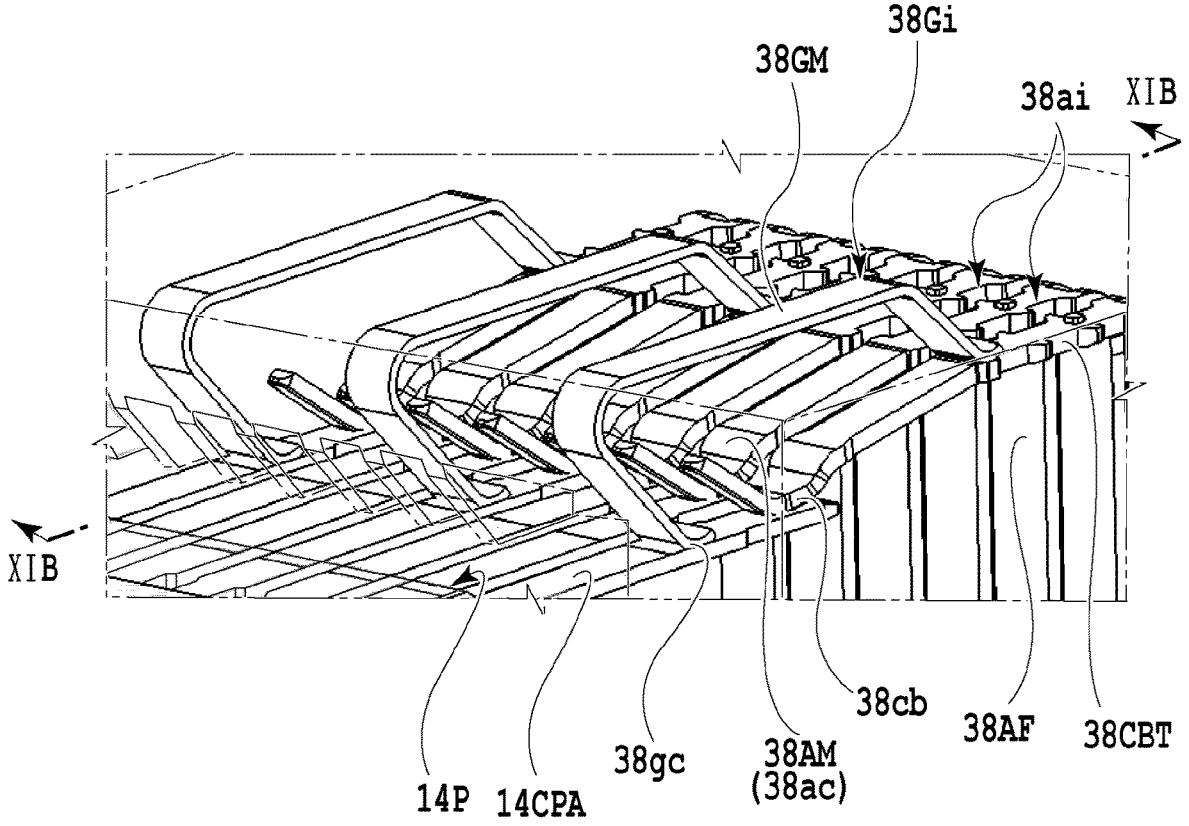
FIG. 11A is a perspective view showing partial enlarged essential parts of a first contact terminal group and of a second contact terminal group which are used in still another example of the host connector according to the present invention.
Figure 11B:
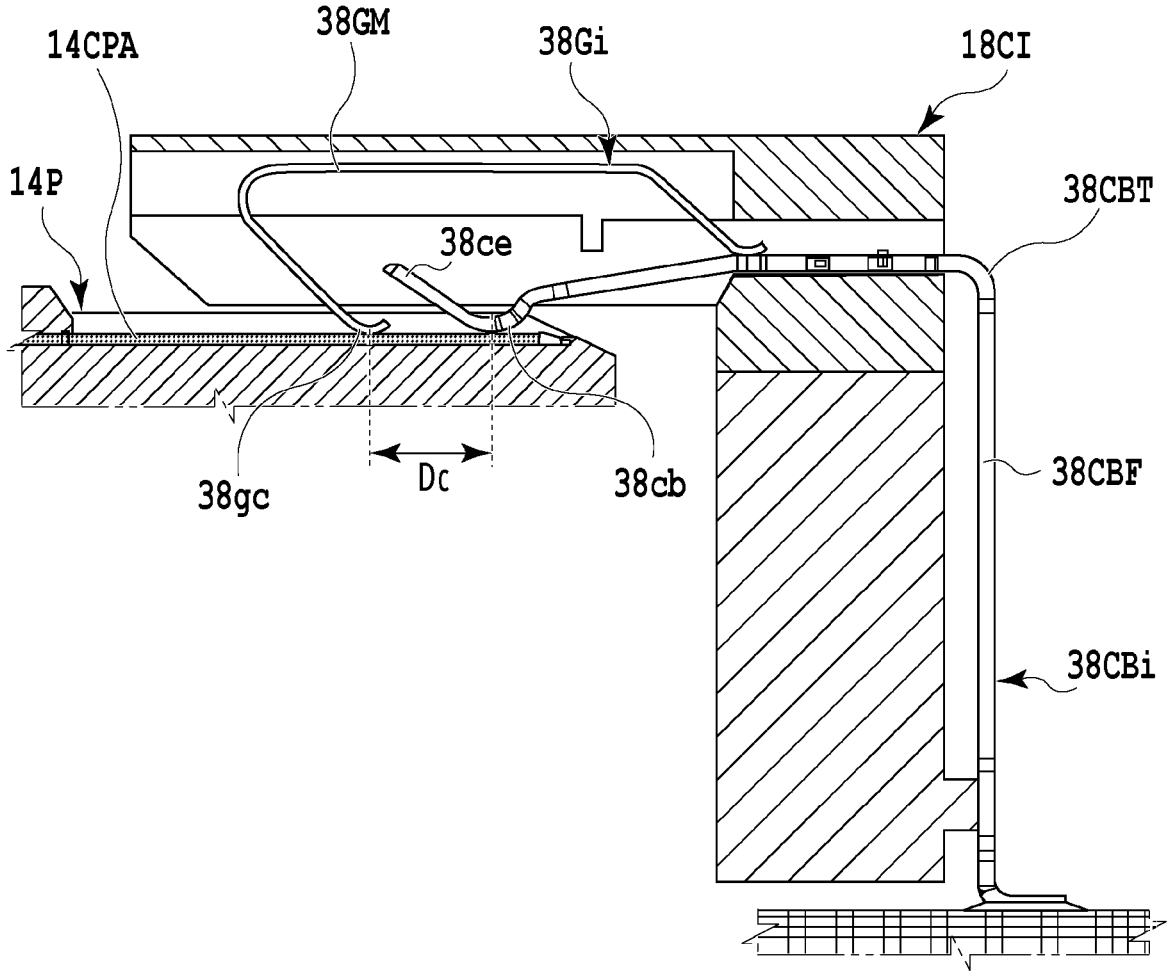
FIG. 11B is a configuration diagram schematically showing a grounding main contact terminal and a grounding sub-contact terminal which constitute part of the first contact terminal group illustrated in FIG. 11A, together with part of a connection end of a module.

FIGS. 11A and 11B show essential parts of a first contact terminal group used in still another example of the host connector according to the present invention.

The host connector comprises: the connector insulator 18CI provided with the slot 18A into which the plug connector 14P of the module 14 described above is detachably inserted; the first contact terminal group formed from the plurality of contact terminals arranged inside the connector insulator 18CI and each brought into contact with the corresponding contact pad 14CPA on the one side at the connection end of the plug connector 14P; and the second contact terminal group formed from the plurality of contact terminals each brought into contact with the corresponding contact pad 14CPB on the other side opposed to the contact pad 14CPA.

Note that structures of the connector insulator 18CI and the second contact terminal group in the example shown in FIGS. 11A and 11B are the same as the structures of the connector insulator 18CI and the second contact terminal group in the example shown in FIG. 2A, and overlapping explanations thereof will be omitted.

As shown in FIGS. 11A and 11B, the first contact terminal group comprises a plurality of grounding sub-contact terminals 38Gi (i=1 to n where n is a positive integer) arranged inside the respective slits 18UCi of the connector insulator 18CI, grounding main contact terminals 38CBi (i=1 to n where n is a positive integer) that support the grounding sub-contact terminals 38Gi, and a plurality of signal contact terminals 38*ai* (i=1 to n where n is a positive integer).

In order to reduce crosstalk between the adjacent channels, the grounding sub-contact terminals 38Gi and the grounding main contact terminals 38CBi are arranged on both besides of a pair of the signal contact terminals 38*ai*, respectively.

Hereby, the first contact terminal group includes the terminals repeatedly arranged from one end to the other end of the connector insulator 18CI in order of the grounding sub-contact terminal 38Gi (G) and the grounding main contact terminal 38CBi (G), the signal contact terminal 38*ai* (S), the signal contact terminal 38*ai* (S), the grounding sub-contact terminal 38Gi (G) and the grounding main contact terminal 38CBi (G), G, S, S, G, and so on.

Each signal contact terminal 38*ai* comprises a movable piece portion 38AM provided with a contact portion 38*ac* brought into contact with the corresponding contact pad 14CPA, and a fixed terminal portion 38AF that is continuous with an end of the movable piece portion 38AM and bent in such a way as to be perpendicular to the surface of the printed wiring board 12.

Each grounding main contact terminal 38CBi comprises a movable piece portion 38CBT provided with a downward convex contact portion 38*cb* and brought into contact with the corresponding contact pad 14CPA, and a fixed terminal portion 38CBF that is continuous with an end of the movable piece portion 38CBT and bent in such a way as to be perpendicular to the surface of the printed wiring board 12. One end of the fixed terminal portion 38CBF is fixed by soldering to the corresponding conductive pattern on the printed wiring board 12 located at the rear part of the connector insulator 18CI. A length of the fixed terminal portion 38CBF is set substantially equal to a length of the fixed terminal portion 38AF of the signal contact terminal 38*ai* mentioned above. An extending portion 38*ce* of the contact portion 38*cb* extends obliquely upward in the direction of the slot 18A so as to be located on an inner side of a first bent portion of the corresponding grounding sub-contact terminal 38Gi to be described later.

Each grounding sub-contact terminal 38Gi has a movable piece portion having a downward convex contact portion 38*gc* provided on another end, which is brought into contact with the shared contact pad 14CPA mentioned above. One end of the movable piece portion is joined to an upper surface of an end of the movable piece portion 38CBT of the corresponding grounding main contact terminal 38CBi. Such joining process may adopt a method such as spot welding or thermal compression bonding, for example.

As shown in FIG. 11B, the other end of the movable piece portion has the first bent portion that extends toward the slot 18A and is bent obliquely downward to the left. A second bent portion being continuous with the first bent portion at the other end of the movable piece portion mentioned above and extending obliquely upward in an opposite direction to the direction to the slot 18A has the downward convex contact portion 38*gc*. A length of the movable piece portion in the direction of attachment and detachment of the connection end of the plug connector 14P is set larger than a length of the movable piece portion 38CBT of the grounding main contact terminal 38CBi.

Herewith, the position of the contact portion 38*gc* of the movable piece portion is located closer to the slot 18A than is the position of the contact portion 38*cb* of the movable piece portion 38CBT of each grounding main contact terminal 38CBi. As shown in FIG. 11B, a center-to-center distance Dc between the contact portion 38*gc* and the contact portion 38*cb* to be brought into contact with different locations on the same contact pad is set in a range from about 1.1 mm to 1.5 mm inclusive, for example.

In the case where signals in a high-frequency band such as signals at 100 KHz or above, for example are transmitted through the signal contact terminals 38*ai* in the state where the plug connector 14P of the module 14 is connected to the host connector 18 as described above, crosstalk will not be increased and frequency characteristics will not be deteriorated because the contact portions 38*cb* of the grounding main contact terminals 38CBi and the contact portions of the signal contact terminals 38*ai* having the same shape to each other are arranged on a common straight line extending along the direction of arrangement of the contact terminals and the plurality of signal contact terminals 38*ai* are disposed between the grounding main contact terminals 38CBi.

Such unique effects have been verified from results obtained by a given simulator conducted by the inventor of the present application.

Figure 12A:
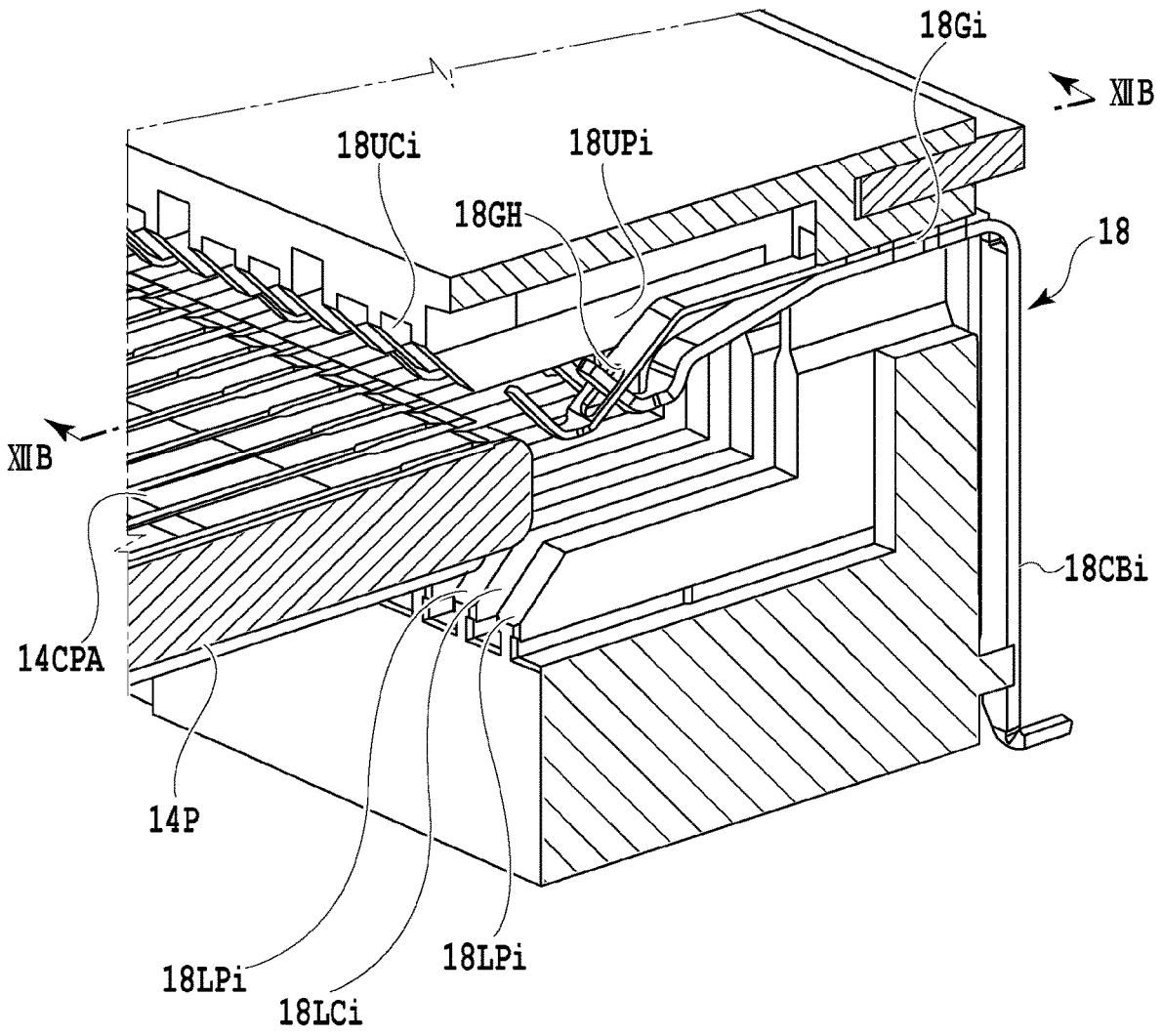
FIG. 12A is a perspective view showing a cross-section of still another example of the host connector according to the present invention.
Figure 12B:
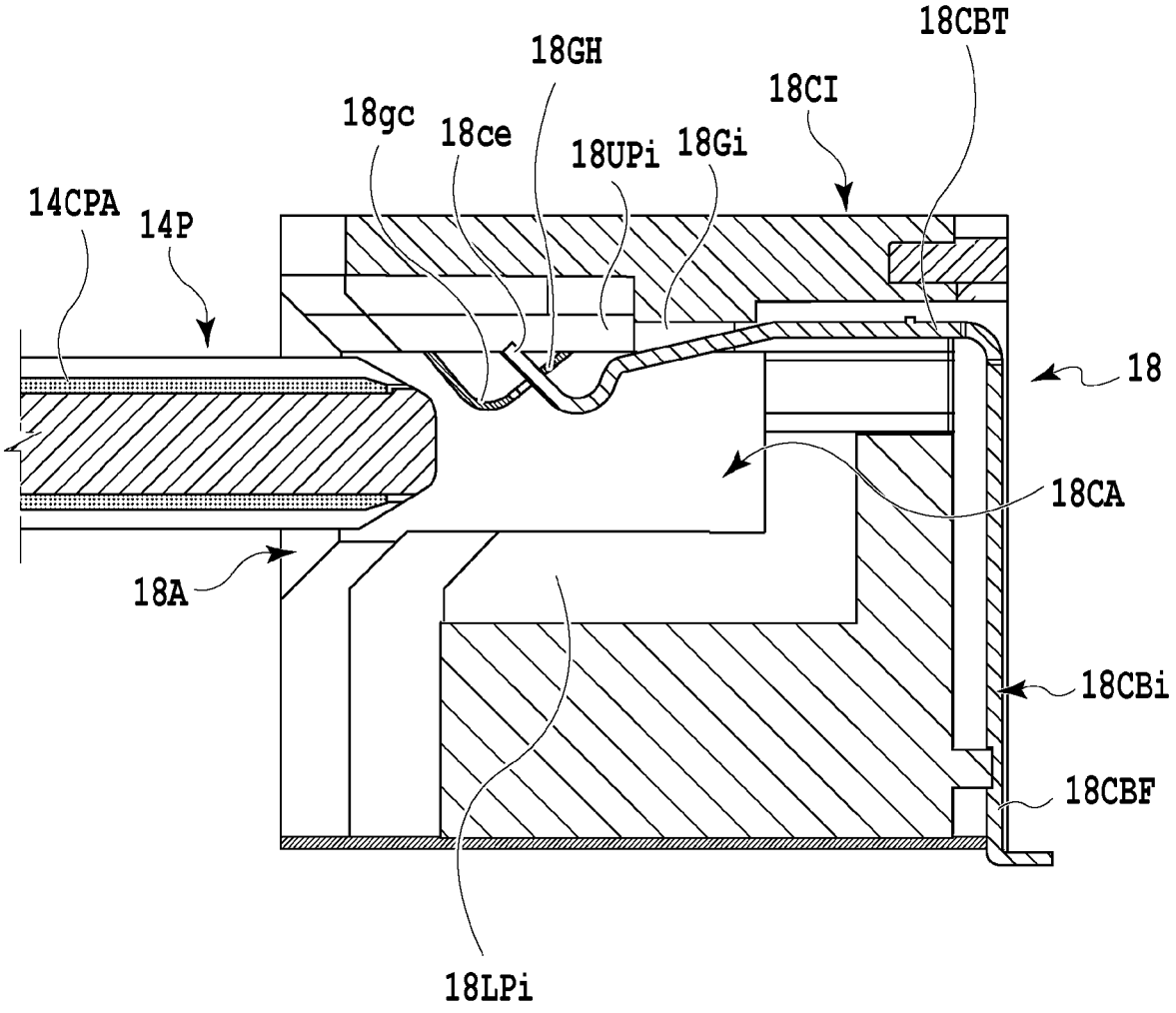
FIG. 12B is a cross-sectional view taken along the XIIB-XIIB line in FIG. 12A.

FIGS. 12A and 12B show essential parts of still another example of the host connector according to the present invention.

The host connector 18 shown in FIGS. 2A and 2B has the configuration which comprises: the connector insulator 18CI provided with the slot 18A into which the plug connector 14P of the module 14 is detachably inserted; the first contact terminal group formed from the plurality of contact terminals arranged inside the connector insulator 18CI and each brought into contact with the corresponding contact pad 14CPA on the one side at the connection end of the plug connector 14P; and the second contact terminal group formed from the plurality of contact terminals each brought into contact with the corresponding contact pad 14CPB on the other side opposed to the contact pad 14CPA. On the other hand, in the example shown in FIGS. 12A and 12B, the host connector 18 does not include the second contact terminal group formed from the plurality of contact terminals each brought into contact with the corresponding contact pad 14CPB on the other side, but only includes the first contact terminal group. Note that constituents in FIGS. 12A and 12B which are the same as the constituents in the example shown in FIGS. 2A and 2B will be indicated by the same reference numerals and overlapping explanations thereof will be omitted.

Figure 13:
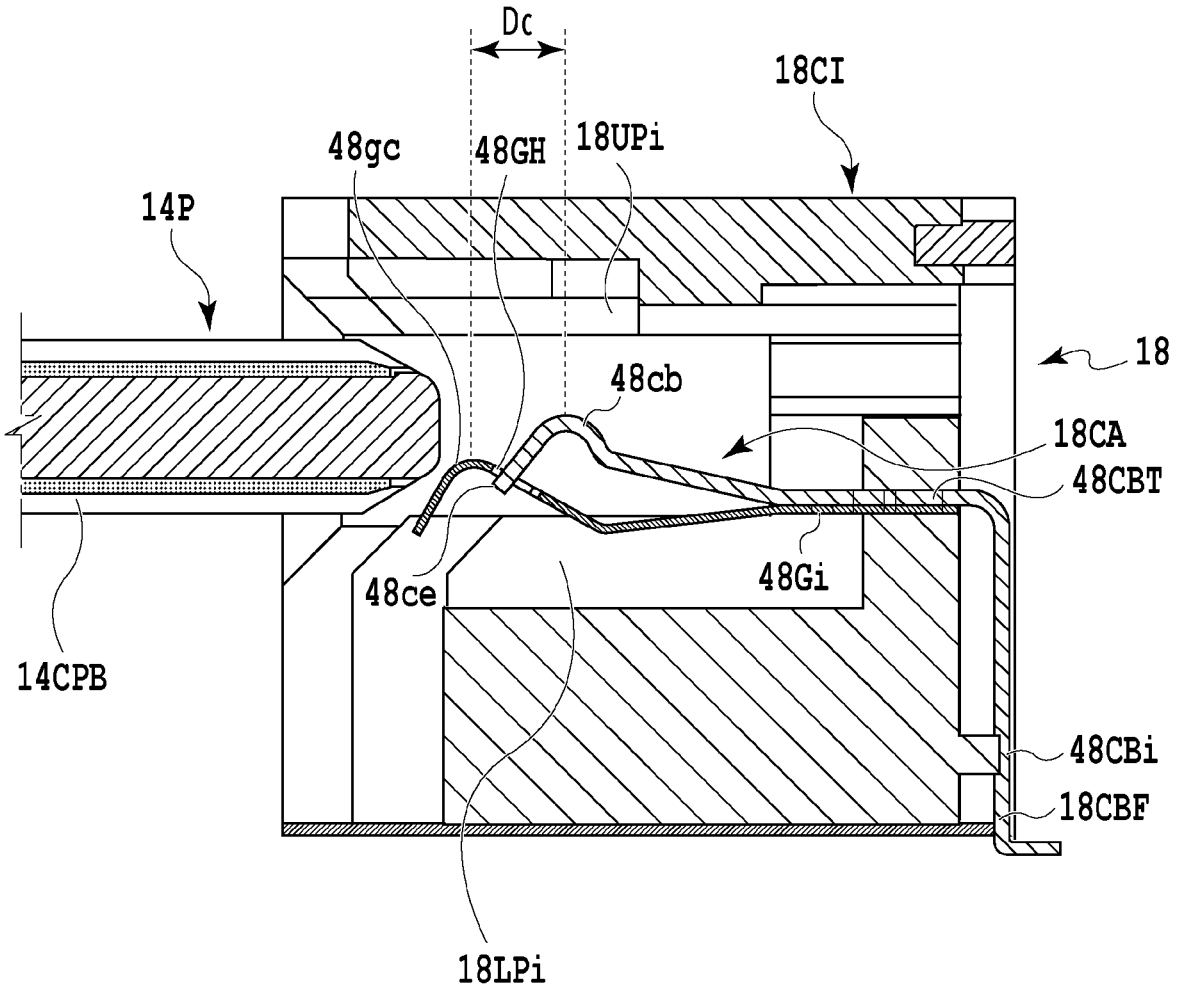
FIG. 13 is a partial cross-sectional view showing a modified example of a grounding contact terminal constituting part of the second contact terminal group used in the example of the host connector according to the present invention.
Figure 14A:
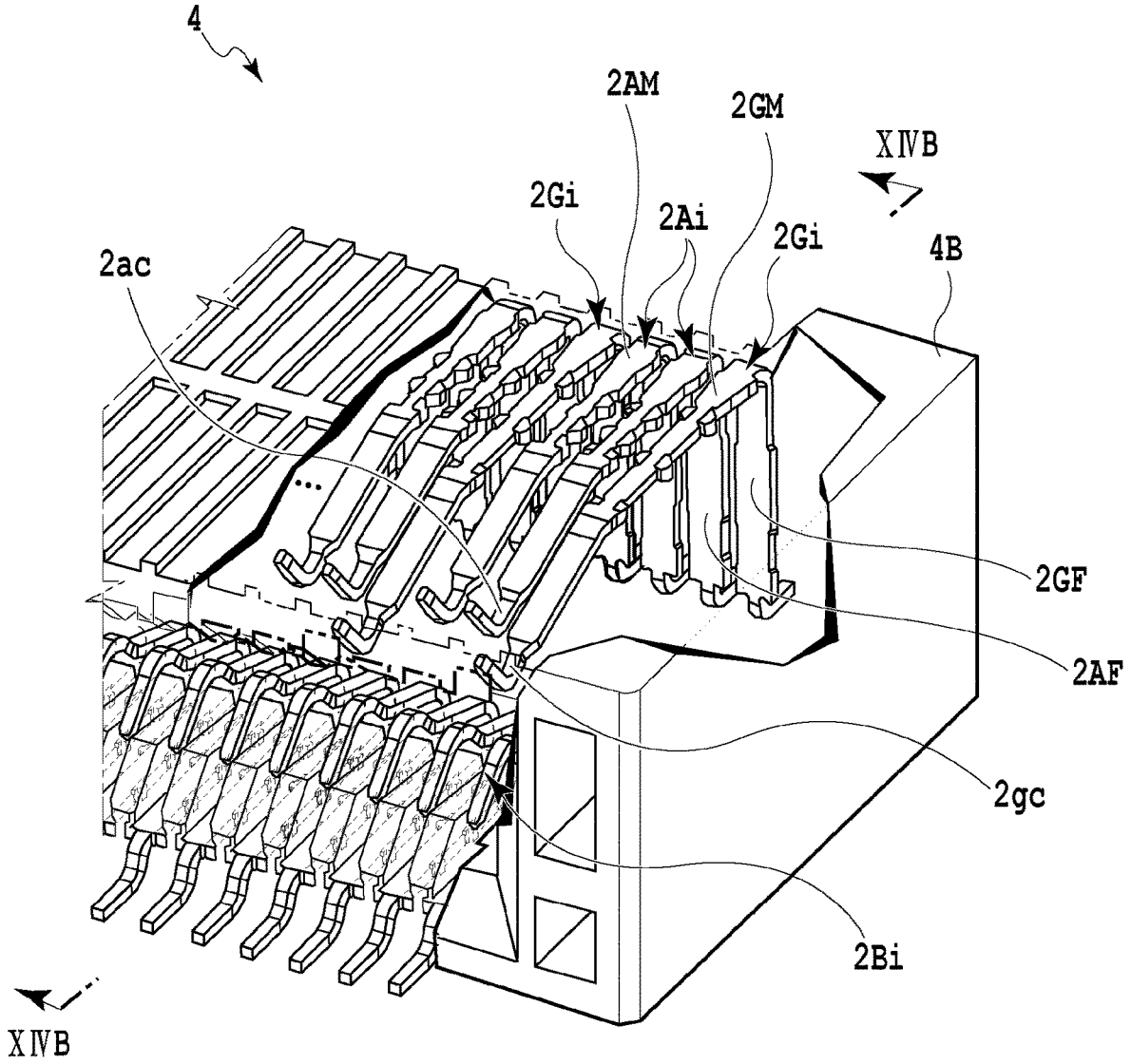
FIG. 14A is a perspective view showing partial enlarged essential parts of a first contact terminal group and of a second contact terminal group in a host connector according to the related art.
Figure 14B:
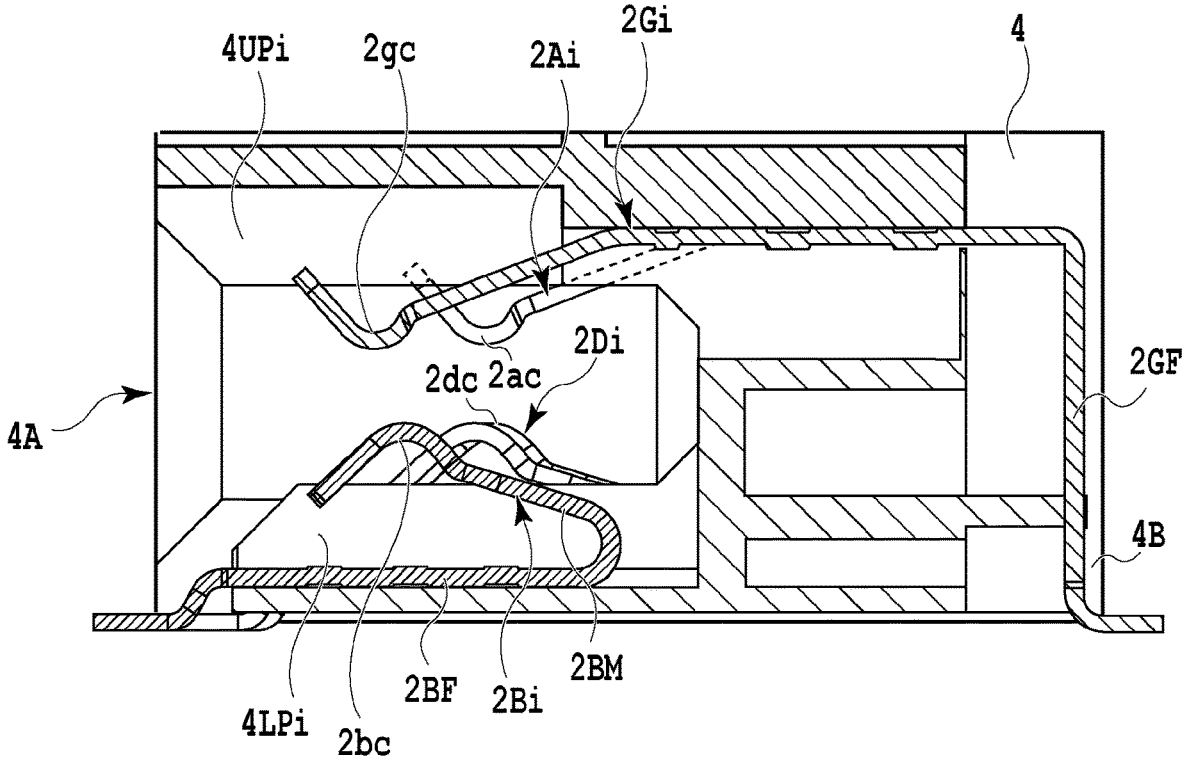
FIG. 14B is a cross-sectional view of the host connector illustrated in FIG. 14A.

The above-described host connector 18 shown in FIGS. 2A and 2B includes the first contact terminal group and the second contact terminal group that is formed from the plurality of contact terminals each brought into contact with the corresponding contact pad 14CPB on the other side opposed to the contact pad 14CPA on the one side at the connection end of the plug connector 14P, and the second contact terminal group includes the plurality of grounding contact terminals 18*bi*. However, the present invention is not limited to this example. As shown in FIG. 13, for instance, the grounding contact terminals constituting part of the second contact terminal group may be formed from a plurality of grounding sub-contact terminals 48Gi (i=1 to n where n is a positive integer) arranged inside the respective slits 18UCi of the connector insulator 18CI and grounding main contact terminals 48CBi (i=1 to n where n is a positive integer) that support the grounding sub-contact terminals 48Gi.

Each grounding main contact terminal 48CBi comprises a movable piece portion 48CBT provided with a contact portion 48*cb* brought into contact with the corresponding contact pad 14CPB, and a fixed terminal portion 48CBF that is continuous with an end of the movable piece portion 48CBT and bent in such a way as to be perpendicular to the surface of the printed wiring board 12. One end of the fixed terminal portion 48CBF is fixed by soldering to the corresponding conductive pattern on the printed wiring board 12 located at the rear part of the connector insulator 18CI. A length of the fixed terminal portion 48CBF is set substantially equal to a length of the fixed terminal portion of the signal contact terminal mentioned above. An extending portion 48*ce* of an upward convex contact portion 48*cb* that extends obliquely downward to the left in the direction of the slot 18A while penetrating a slit 48GH of the corresponding grounding sub-contact terminal 48Gi to be described later.

Each grounding sub-contact terminal 48Gi has a movable piece portion having an upward convex contact portion 48*gc* provided on another end, which is brought into contact with the shared contact pad 14CPB mentioned above. One end of the movable piece portion is joined in an overlapping manner to a lower surface of an end of the movable piece portion 48CBT of the corresponding grounding main contact terminal 48CBi. Such joining process may adopt a method such as spot welding or thermal compression bonding, for example.

The other end of the movable piece portion of the grounding sub-contact terminal 48Gi mentioned above extends obliquely downward to the left toward the slot 18A and is then bent upward. A bent portion at the other end of the movable piece portion extending obliquely upward to the left has the slit 48GH that allows penetration of the extending portion 48*ce* of the contact portion 48*cb* of the grounding main contact terminal 48CBi. A length of the movable piece portion in the direction of attachment and detachment of the connection end of the plug connector 14P is set larger than a length of the movable piece portion 48CBT of the grounding main contact terminal 48CBi.

Herewith, the position of the contact portion 48*gc* of the movable piece portion is located closer to the slot 18A than is the position of the contact portion 48*cb* of the movable piece portion 48CBT of each grounding main contact terminal 48CBi. As shown in FIG. 13, a center-to-center distance Dc between the contact portion 48*gc* and the contact portion 48*cb* to be brought into contact with different locations on the same contact pad is set in a range from about 1.1 mm to 1.5 mm inclusive, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A host connector comprising:

a connector insulator including a slot into which a connection end of a module is detachably inserted; and a contact terminal group formed from a plurality of contact terminals placed inside the connector insulator and each brought into contact with a contact pad on the connection end of the module, wherein the contact terminal group comprises a plurality of grounding sub-contact terminals, grounding main contact terminals for supporting ends of the grounding sub-contact terminals, respectively, and a plurality of signal contact terminals having a shape identical to a shape of the grounding main contact terminals, a contact portion of each grounding main contact terminal and a contact portion of each signal contact terminal are arranged on a common straight line extending along a direction of arrangement of the contact terminals, the plurality of signal contact terminals are disposed between the grounding main contact terminals, and a center-to-center distance between a contact portion of the grounding sub-contact terminal and the contact portion of the grounding main contact terminal to be brought into contact with different locations on a same contact pad of a module is set in a predetermined range.

2. A host connector comprising:

a connector insulator including a slot into which a connection end of a module is detachably inserted;

a first contact terminal group formed from a plurality of contact terminals placed inside the connector insulator and each brought into contact with a contact pad on one side of the connection end of the module; and a second contact terminal group formed from a plurality of contact terminals each brought into contact with a contact pad on another side opposed to the contact pad on the one side of the connection end, wherein the first contact terminal group comprises a plurality of grounding sub-contact terminals, grounding main contact terminals for supporting ends of the grounding sub-contact terminals, respectively, and a plurality of signal contact terminals having a shape identical to a shape of the grounding main contact terminals, a contact portion of each grounding main contact terminal and a contact portion of each signal contact terminal are arranged on a common straight line extending along a direction of arrangement of the contact terminals, the plurality of signal contact terminals are disposed between the grounding main contact terminals, and a center-to-center distance between a contact portion of the grounding sub-contact terminal and the contact portion of the grounding main contact terminal to be brought into contact with different locations on a same contact pad of a module is set in a predetermined range.

3. The host connector according to claim 2, wherein a frequency of a signal transmitted through at least one of the signal contact terminals constituting the first contact terminal group is higher than a frequency of a signal transmitted through a signal contact terminal constituting the second contact terminal group.

4. The host connector according to claim 2, wherein an end of each grounding sub-contact terminal is joined in an overlapping manner to an upper surface of an end of a movable piece portion of each grounding main contact terminal.

5. The host connector according to claim 2, wherein a position of a contact portion of each grounding sub-contact terminal is set to a position closer to the slot of the connector insulator than a position of a contact portion of each grounding main contact terminal is.

6. The host connector according to claim 5, wherein a center-to-center distance between the contact portion of the grounding sub-contact terminal and the contact portion of the grounding main contact terminal to be brought into contact with the same contact pad is set in a range from about 1.1 mm to 1.5 mm inclusive.

7. A receptacle assembly comprising:

a guide member placed on a wiring board and for forming a module accommodating portion that detachably accommodates a module including a module board and guiding the module;

the host connector according to claim 1 placed on the wiring board and located adjacent to the module accommodating portion; and a connector cover for covering the host connector.

8. A receptacle assembly comprising:

a guide member placed on a wiring board and for forming a module accommodating portion that detachably accommodates a module including a module board and guiding the module;

the host connector according to claim 2 placed on the wiring board and located adjacent to the module accommodating portion; and a connector cover for covering the host connector.

9. A host connector comprising:

a connector insulator including a slot into which a connection end of a module is detachably inserted;

a first contact terminal group formed from a plurality of contact terminals arranged inside the connector insulator and each brought into contact with a contact pad on one side at the connection end of the module; and a second contact terminal group formed from a plurality of contact terminals each brought into contact with a contact pad on another side opposed to the contact pad on the one side at the connection end, wherein the first contact terminal group includes a plurality of grounding sub-contact terminals, grounding main contact terminals configured to support ends of the grounding sub-contact terminals, respectively, and a plurality of signal contact terminals having a shape identical to a shape of the grounding main contact terminals, a contact portion of each grounding main contact terminal and a contact portion of each signal contact terminal are arranged on a common straight line extending along a direction of arrangement of the contact terminals, the plurality of signal contact terminals are disposed between the grounding main contact terminals, a position of a contact portion of each grounding sub-contact terminal is set to a position closer to the slot of the connector insulator than is a position of the contact portion of each grounding main contact terminal, and a center-to-center distance between the contact portion of the grounding sub-contact terminal and the contact portion of the grounding main contact terminal to be brought into contact with a same contact pad of a module is set in a range from 1.1 mm to 1.5 mm inclusive.

* * * * *